US008910805B2

(12) United States Patent
Gregory et al.

(10) Patent No.: US 8,910,805 B2
(45) Date of Patent: Dec. 16, 2014

(54) SHELVING SYSTEM AND COMPONENTS

(75) Inventors: Michael Gregory, Huntersville, NC (US); Robert John Warner, Jr., Cornelius, NC (US)

(73) Assignee: Rubbermaid Incorporated, Huntersville, NC (US)

( * ) Notice: Subject to any disclaimer, the term of this patent is extended or adjusted under 35 U.S.C. 154(b) by 112 days.

(21) Appl. No.: 13/590,716

(22) Filed: Aug. 21, 2012

(65) Prior Publication Data

US 2013/0032560 A1 Feb. 7, 2013

Related U.S. Application Data

(63) Continuation-in-part of application No. 13/204,279, filed on Aug. 5, 2011, now Pat. No. 8,701,901.

(51) Int. Cl.
*A47F 5/08* (2006.01)
*A47B 43/00* (2006.01)

(52) U.S. Cl.
CPC ..... *A47B 43/006* (2013.01)
USPC ..... 211/113; 108/42; 211/187

(58) Field of Classification Search
CPC .... A47B 96/024; A47B 96/06; A47B 96/063; A47B 96/066; A47G 25/746
USPC ..... 108/42, 47, 48, 180; 211/118, 113, 134, 211/85.29, 117, 86.01, 149, 151, 180, 211/85.31; 312/245
See application file for complete search history.

(56) References Cited

U.S. PATENT DOCUMENTS 2,115,323 A * 4/1938 Wuest ..... 108/167
2,969,154 A * 1/1961 Pelletier ..... 211/85.31
3,598,064 A * 8/1971 Stempel ..... 108/42
4,311,243 A * 1/1982 Hui-Lai ..... 211/113
4,388,982 A * 6/1983 Yonahara ..... 182/82
4,726,317 A * 2/1988 Ritten et al. ..... 114/362
5,180,067 A * 1/1993 Conaway et al. ..... 211/119
5,427,340 A * 6/1995 Stromsmoe et al. ..... 248/97
6,105,509 A * 8/2000 Altfeder ..... 108/42
6,116,164 A * 9/2000 Justen, Jr. ..... 108/42
6,145,678 A * 11/2000 Morrison ..... 211/113
6,286,691 B1 * 9/2001 Oberhaus et al. ..... 211/118

(Continued)

OTHER PUBLICATIONS

Michael Graves Design, Three Shelf Organizer, Model Number: A-05614-0041-ST, picture taken Oct. 15, 2010.

(Continued)

*Primary Examiner* — Jose V Chen
(74) *Attorney, Agent, or Firm* — Matthew W. Witsil; Moore & Van Allen PLLC

(57) ABSTRACT

A shelving system including brackets and shelves suspended by flexible or rigid straps from various types of shelving. The shelving system includes two frames that may include wire for forming ends of the shelving system. Each frame includes a shelf supporting element including first and second shelf rod receiving elements. A shelf is provided that includes first and second spaced rods. The rod receiving elements are configured to receive and support the rods. In another embodiment, a shelving system includes at least two brackets that are configured to engage a fixed shelf, and at least one rigid strap depending from each bracket. Two frames are each associated with and releaseably attached to one of the rigid straps and include a shelf supporting element including a shelf retaining portion. A shelf is supported by the shelf supporting element and is retained in place with the shelf retaining portion.

18 Claims, 45 Drawing Sheets

(56) References Cited

U.S. PATENT DOCUMENTS

| | | | | |
|---|---|---|---|---|
| D485,458 | S * | 1/2004 | Govrik et al. | D6/511 |
| 6,814,418 | B2 * | 11/2004 | D'Orso | 108/149 |
| 8,602,370 | B2 * | 12/2013 | Mckenzie | 248/215 |

OTHER PUBLICATIONS

Neatfreak, Six Shelf Organizer, Model Number: A-05662-03X1-D1EF, picture taken Oct. 15, 2010.

* cited by examiner

SHELVING SYSTEM AND COMPONENTS

CROSS-REFERENCE TO RELATED APPLICATIONS

This application is a continuation-in-part of U.S. patent application Ser. No. 13/204,279, titled "Shelving System and Components," and filed Aug. 5, 2011, the contents of which are incorporated herein in their entirety by reference.

BACKGROUND

The system disclosed herein relates generally to the field of shelving, and particularly may relate to support of a structure hanging from shelving.

Installation of shelving generally requires tools, time, and some degree of skill by an installer. Such installation may also require changing existing shelving systems, which may be undesirable or not allowed in certain situations.

Conventional hanging organizers may be used as a solution for additional storage with shelving in a closet or other places where there is a rod for hanging articles, independent of mounting the shelving directly to a wall. Many hanging organizers attach to a hanger rod with hooks or one or more straps that may be attached with hook and loop fasteners. The organizers are often soft sided, being a three sided fabric enclosure with shelves in it accessible from the open side or a side that may be opened with a zipper. Because the organizers are generally centered from front to back on the hanger rod, there is a significant amount of unused space behind the organizer and in front of the wall, and the front of the organizer extends out into the room, which may impede traffic in front of the shelf. The shelving may be suspended from only two straps, which can lend to instability of the shelves. The shelves of soft sided organizers often deflect with just a small amount of weight on them, and may lack the ability to adjust the height of the shelves.

SUMMARY

In accordance with one embodiment described herein, a bracket for hanging a structure supported by one or more straps from a solid surface shelf is provided. The solid shelf may include front edge and a deck having a top and a bottom, and the bracket includes elongated first and second legs and a connecting portion. The elongated first leg and the elongated second leg each have a proximal end and a distal free end. The proximal end of the first leg and the proximal end of the second leg are both connected to the connecting portion. The first leg and second leg are substantially parallel and extend from the connecting portion in substantially the same direction to define an elongated opening. The opening is adapted to receive the front edge and a portion of the deck of the shelf.

In accordance with another embodiment described herein, a bracket for hanging a structure supported by one or more straps from a wire shelf deck is provided. The bracket includes a plate having a body and first edge parallel to and spaced from a second edge. The first and second edges are bent in the same direction relative to the body, and the body defines first and second substantially parallel slots adapted to receive a strap. The slots are substantially parallel to the first and second edges.

In accordance with another embodiment described herein, a shelf for hanging from a plurality of straps is provided. The shelf comprises a deck and a first clamp. The deck has a first end and a second end, and defines a plurality of slots adapted to allow the straps to pass through. The first clamp is mounted to the deck, and has a first position for engaging at least one strap at an associated slot, and a second position for allowing the strap to slide in the associated slot.

In accordance with another embodiment described herein, a shelving system for mounting to a fixed shelf that is in a substantially fixed position is provided. The shelving system includes a bracket that engages the fixed shelf, at least one strap extending from the bracket, and a shelf releasably attached to any applicable straps.

In accordance with another embodiment described herein, a shelving system is provided. The shelving system includes two frames that include wire. The frames are for forming ends of the shelving system, and each frame includes a shelf supporting element including a first shelf rod receiving element and a second shelf rod receiving element. A shelf is provided that includes a first rod and a second rod spaced from the first rod. The first shelf rod receiving elements are configured to receive and support the first rod, and the second shelf rod receiving elements are configured to receive and support the second rod.

In accordance with another embodiment described herein, a shelving system is provided for mounting to a fixed shelf that is in a substantially fixed position. The shelving system includes at least two brackets that are configured to engage the fixed shelf, and at least one rigid strap depending from each bracket. Two frames are each associated with and releasably attached to one of the rigid straps and include a shelf supporting element including a shelf retaining portion. A shelf is supported by the shelf supporting element and is retained in place with the shelf retaining portion.

In accordance with another embodiment described herein, a method is provided for assembling a shelving system for mounting to a fixed shelf that is in a substantially fixed position. The method includes mounting at least two brackets to the shelf and hanging at least one rigid strap to each bracket. A frame is hung from each rigid strap, with each frame including a shelf supporting element including a shelf rod receiving element, biasing means, and a shelf retaining portion. A shelf includes shelf rods and is positioned above the shelf supporting element. The shelf retaining portion is deflected to allow the shelf to pass thereby. The shelf is seated on each shelf supporting element such that the rods are received in the shelf rod receiving elements, and the shelf rod retaining element is allowed to be positioned above the shelf to retain the shelf in position with the rods seated in the shelf rod receiving elements.

Other aspects and features of the present disclosure, as defined solely by the claims, will become apparent to those ordinarily skilled in the art upon review of the following non-limiting detailed description of the disclosure in conjunction with the accompanying figures.

BRIEF DESCRIPTION OF THE DRAWINGS

For a more complete understanding of the shelving system and components described herein, reference should now be had to the embodiments shown in the accompanying drawings and described below. In the drawings.

DETAILED DESCRIPTION

Certain terminology is used herein for convenience only and is not to be taken as a limitation on the embodiments described. For example, words such as "top", "bottom", "upper," "lower," "left," "right," "horizontal," "vertical," "upward," and "downward" merely describe the configuration shown in the figures. Indeed, the referenced components may be oriented in any direction and the terminology, therefore, should be understood as encompassing such variations unless specified otherwise.

Figure 1:
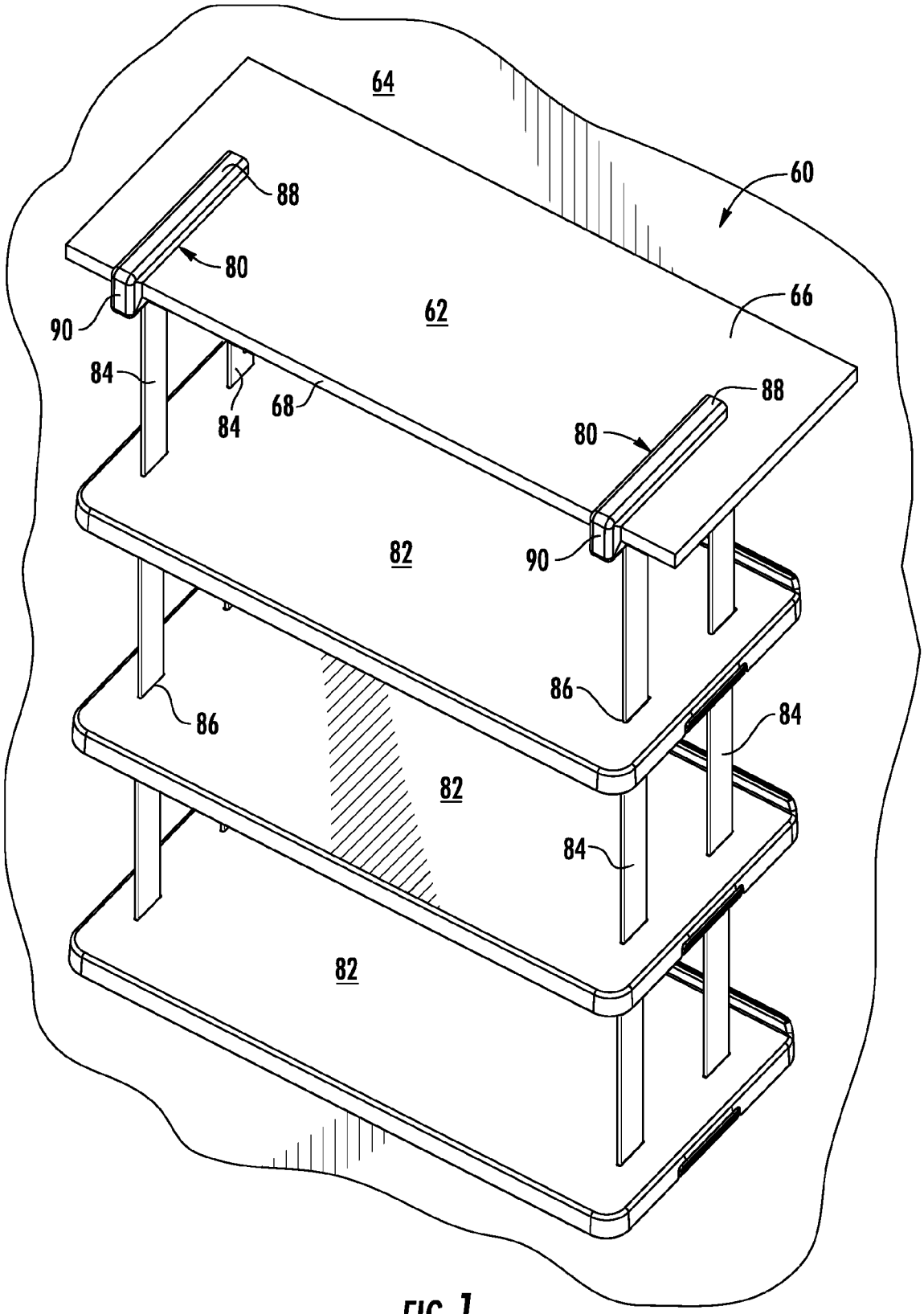
FIG. 1 is a perspective view from above of an embodiment of a shelving system with attachment brackets and a solid surface support shelf mounted to a wall.

Referring now to the drawings, wherein like reference numerals designate corresponding or similar elements throughout the several views, an embodiment of a shelving system is shown in FIG. 1, and is generally designated as 60. The system 60 is shown with a solid surface support shelf 62 mounted to a wall 64, though other mounting configurations, such as to posts or poles, are possible. The solid surface support shelf 62 may be, for example, wood, laminate, or plastic, but generally may be any material with substantially flat top and bottom surfaces as selected by one of ordinary skill in the art. The system 60 may further include means of mounting the shelf 62 to the wall 64 that is not shown, such as mounting strips fastened to the wall 64, with support brackets (not shown) mounted to the mounting strips at one end of the support bracket and supporting the free edge of the shelf 62 with the other end of the support bracket. The support brackets can be placed at various positions in the mounting strips to vary the height of the shelf 62. The shelf 62 includes a deck 66 and a front edge 68.

Figure 2:
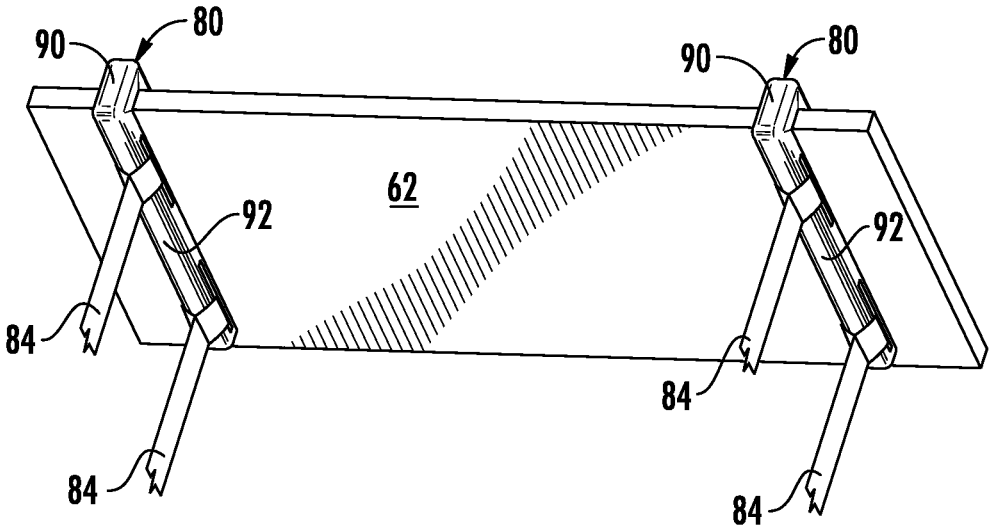
FIG. 2 is a perspective view from below of the support shelf and a first embodiment of the attachment brackets shown in FIG. 1.
Figure 4:
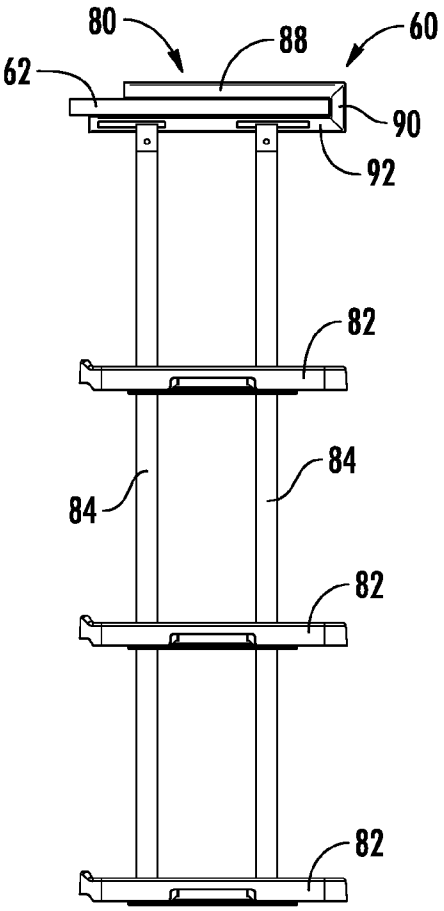
FIG. 4 is a right side elevation view of the shelving system shown in FIG. 1 with the attachment brackets shown in FIG. 2.
Figure 3:
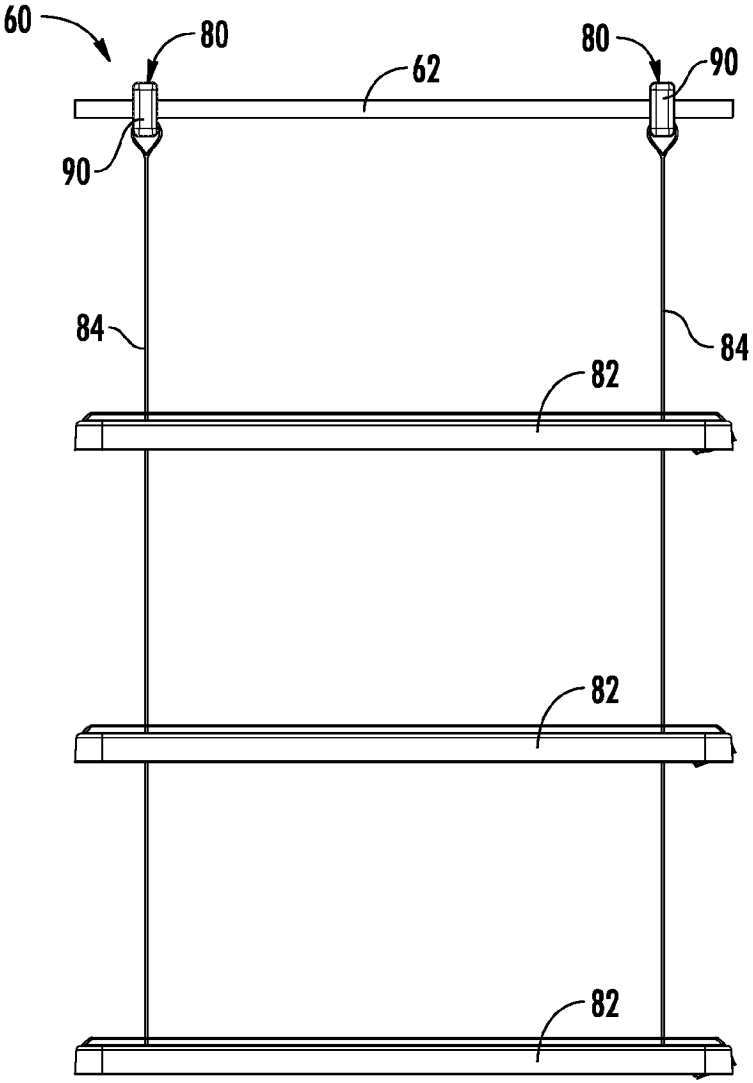
FIG. 3 is a front elevation view of the shelving system shown in FIG. 1.
Figure 5:
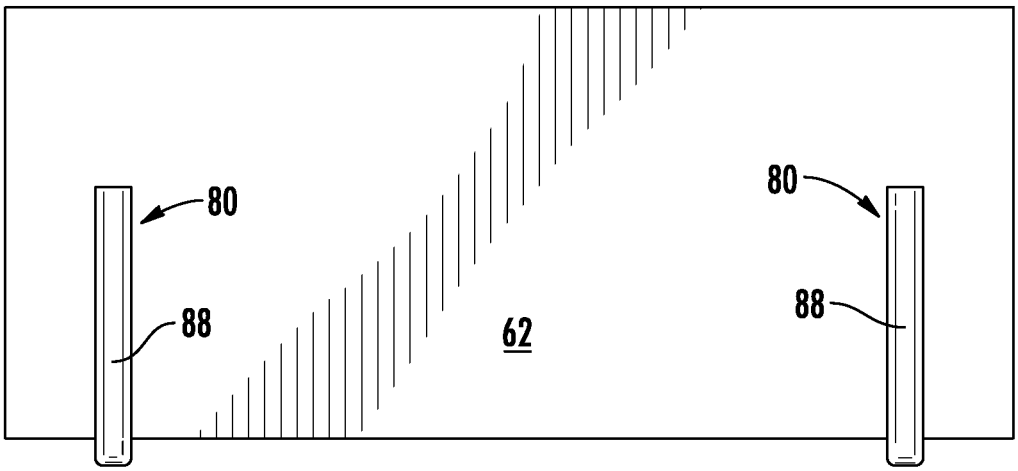
FIG. 5 is a top plan view of the shelving system shown in FIG. 1.
Figure 6:
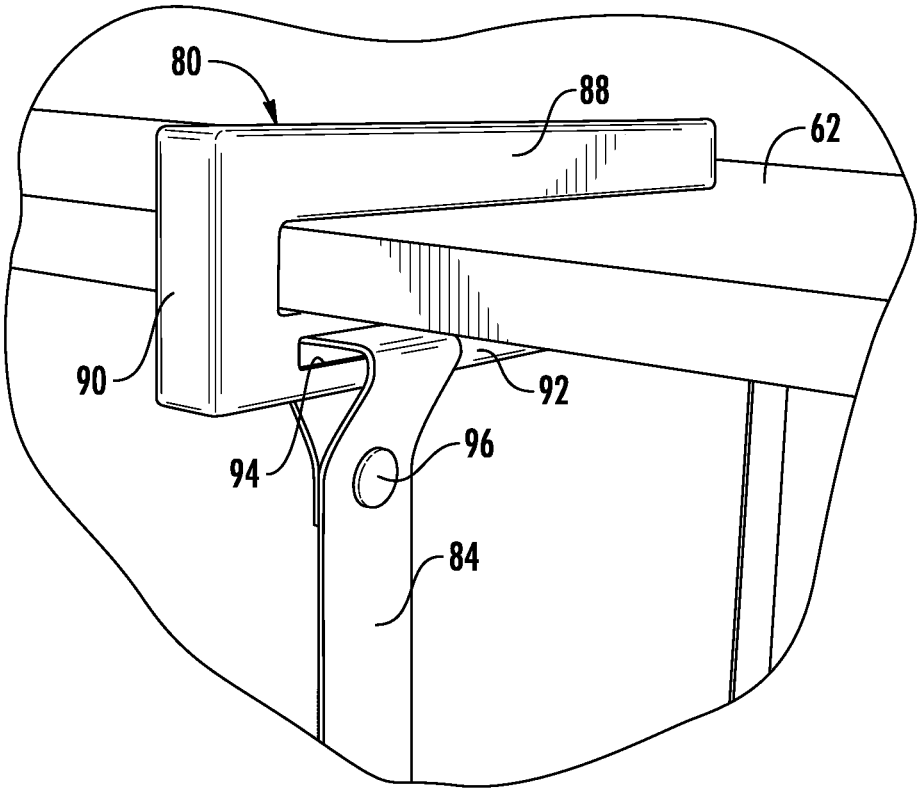
FIG. 6 is a detailed perspective view of the support shelf and the attachment bracket shown in FIG. 2.

Two solid shelf attachment brackets 80 are mounted to the support shelf 62, and hanging shelves 82 are suspended from the attachment brackets 80 with straps 84 passing through slots 86. The attachment brackets 80 are substantially U-shaped, having a top leg 88, a front portion 90, and a bottom leg (not shown in FIG. 1). FIG. 2 shows the bottom leg 92 of the attachment bracket 80 in position on the shelf 62. FIGS. 3, 4, and 5 show front elevation view, side view, and top plan view of the system 60, respectively. A front strap 84 passing through a slot 94 in the attachment bracket 80 is shown in FIG. 6. The strap 84 forms a loop through the slot 94 and may be fastened to itself with a snap 96, rivet, or other fastening means.

Figure 7:
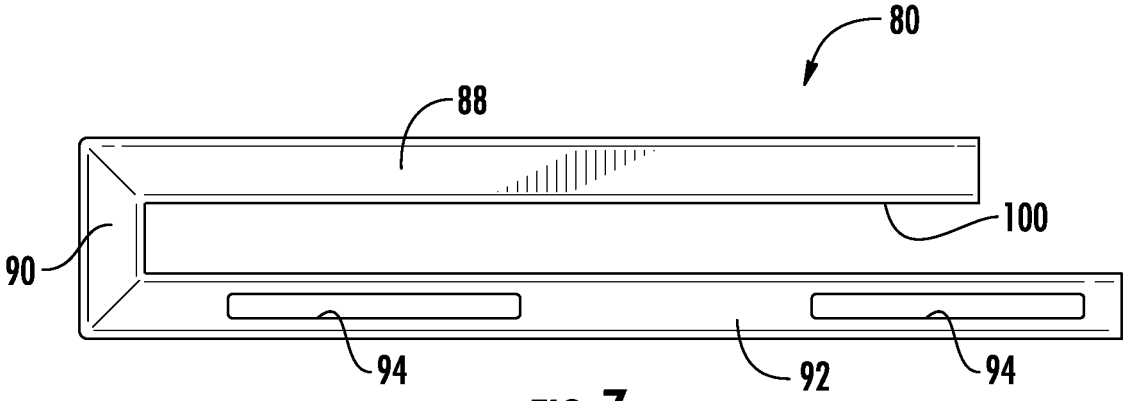
FIG. 7 is a right side elevation view of the attachment bracket shown in FIG. 2.
Figure 8:
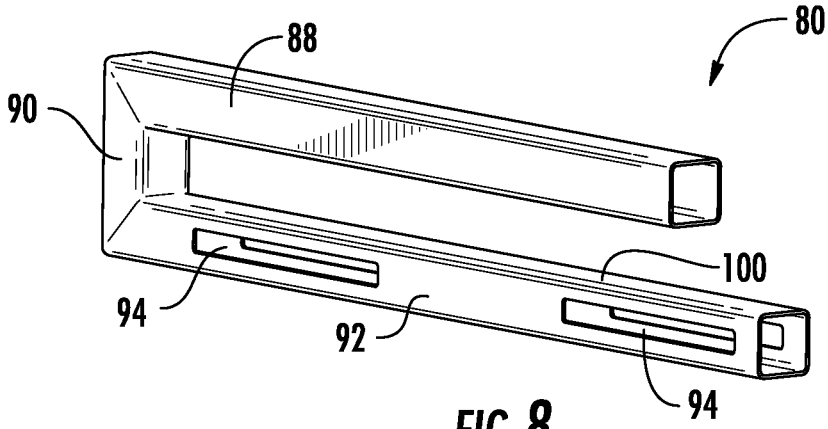
FIG. 8 is a left perspective view from the back of the attachment bracket shown in FIG. 2.

The attachment bracket 80 is further detailed in FIGS. 7 and 8. The top leg 88 of the attachment bracket 80 is substantially parallel to and opposes the bottom leg 92 to form an opening 100, and the front portion 92 connects the two legs 88, 92. This configuration permits sliding of the attachment bracket 80 around the shelf 62 for mounting of the attachment bracket 80 on the shelf 62, with the top leg 88 resting on the shelf deck 66, the front portion 90 in contact with or proximate to the front edge 68 of the shelf 62, and the bottom leg 92 in contact with or proximate to the bottom of the deck 66. In this embodiment, there are two slots 94 through the bottom leg 92. The slots 94 may be at substantially the same position with respect to the height of the bottom leg 92, in this case centered on the height of the bottom leg 92, or could be positioned at different heights than shown. The slots 94 may be spaced from front to back of the bottom leg 92, which spaces the straps 84 to provide, with two attachment brackets 80 with two slots 94, four points of support for each hanging shelf 82. The top leg 88 and bottom leg 92 may be different lengths; in the embodiment shown the bottom leg 92 is longer than the top leg 88.

The attachment bracket 80 may be made of a variety of materials; in the embodiment shown, the attachment bracket 80 is made of metal tubing that is substantially square in cross-section, cut in two places, and folded and welded at the corners or otherwise secured in the desired shape. In one embodiment, the metal tubing is approximately 0.75 inches on each side in cross section, and the wall thickness is approximately 0.4 inches, or at least approximately 0.039 inches. The attachment bracket 80 may also be other closed cross-sectional shapes, and although the embodiment shown has open ends, the ends could be closed with, for example, plastic plugs or metal. The slots 94 may be punched as known to one of ordinary skill in the art. Possible materials for the attachment bracket 80 include plastic, wood, or composite in addition to metal.

Figure 9:
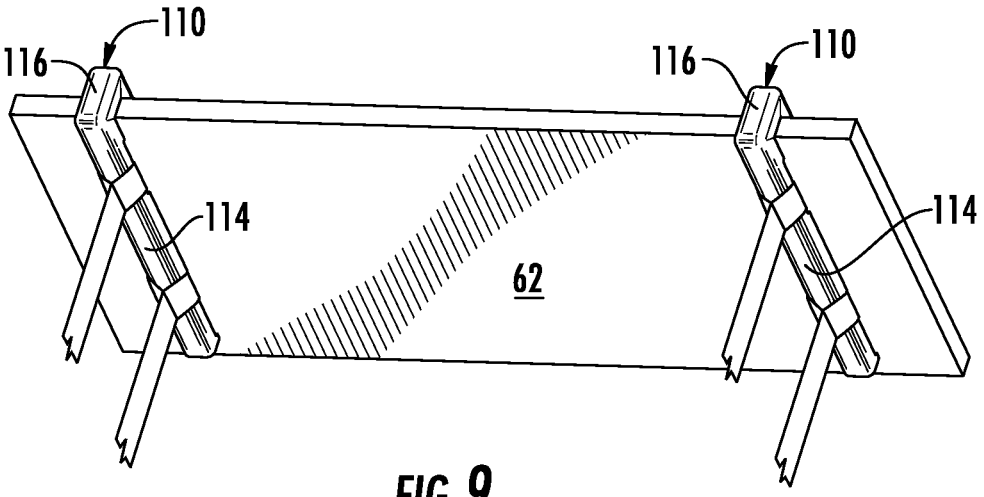
FIG. 9 is a perspective view from below of the support shelf and a second embodiment of the attachment brackets shown in FIG. 1.
Figure 10:
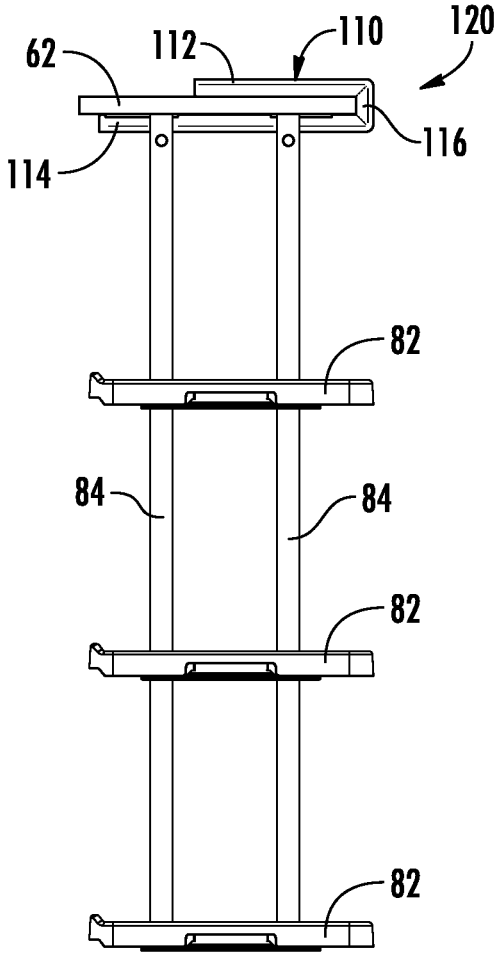
FIG. 10 is a right side elevation view of the shelving system shown in FIG. 1 with the attachment brackets shown in FIG. 9.
Figure 11:
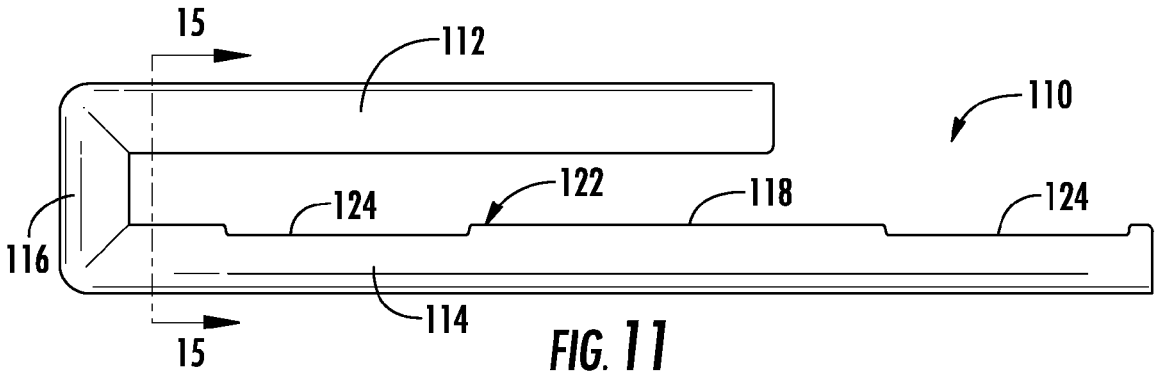
FIG. 11 is a right side elevation view of the attachment bracket shown in FIG. 9.
Figure 12:
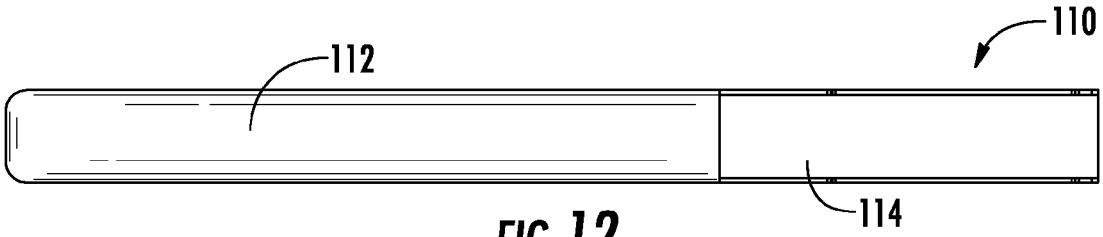
FIG. 12 is a top plan view of the attachment bracket shown in FIG. 11.
Figure 13:
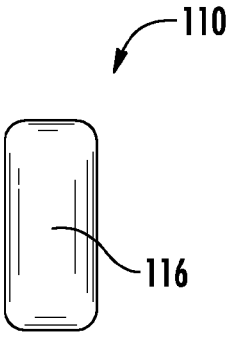
FIG. 13 is a rear elevation view of the attachment bracket shown in FIG. 11.
Figure 14:
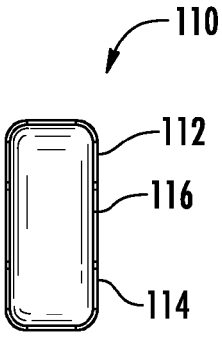
FIG. 14 is a front elevation view of the attachment bracket shown in FIG. 11.
Figure 15:
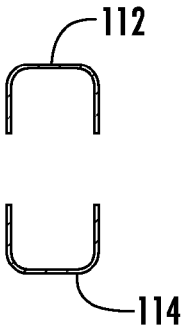
FIG. 15 is a section view taken along line 15-15 of FIG. 11.
Figure 16:
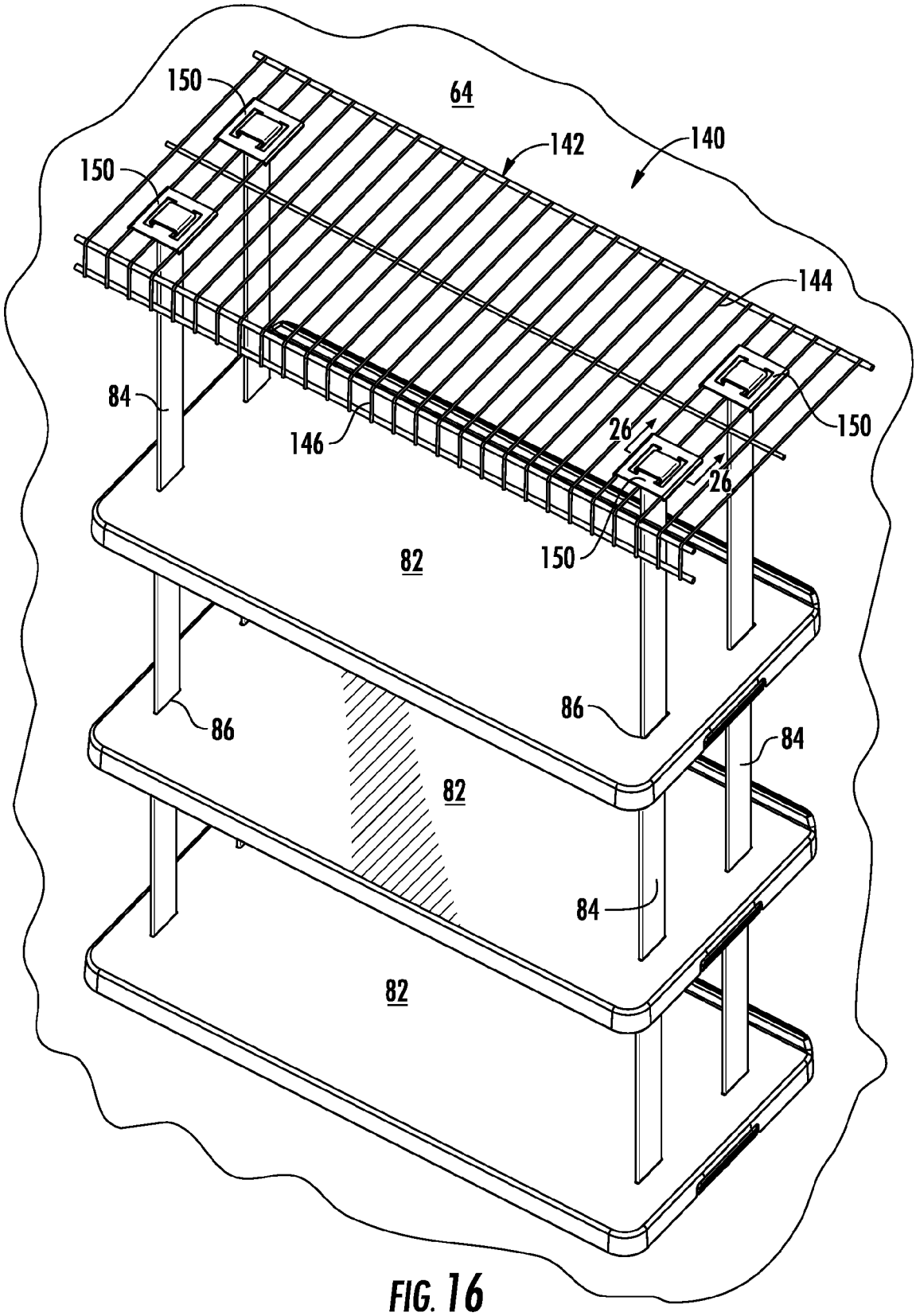
FIG. 16 is a perspective view from above of an embodiment of a shelving system with attachment brackets on a wire support shelf mounted to a wall.
Figure 17:
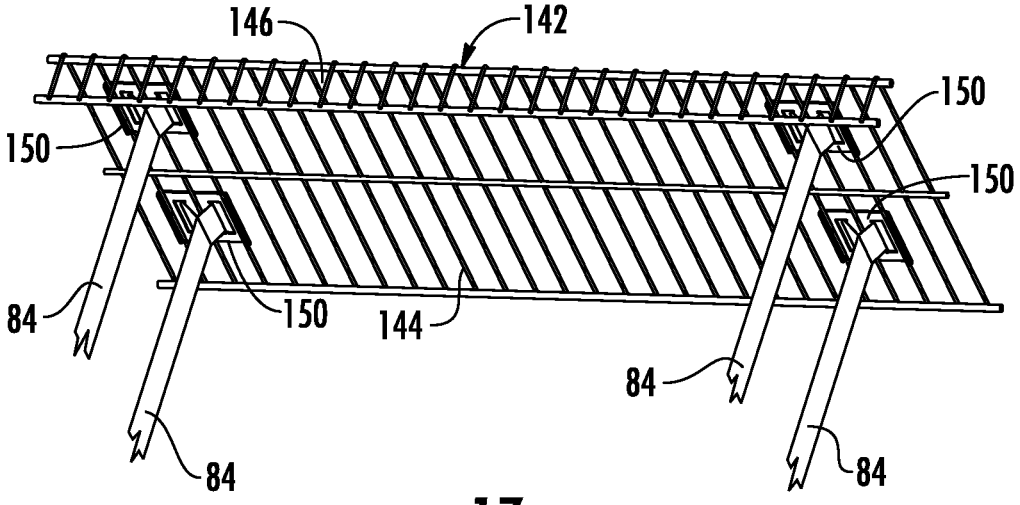
FIG. 17 is a perspective view from below of the support shelf and an embodiment of the attachment brackets shown in FIG. 1.
Figure 19:
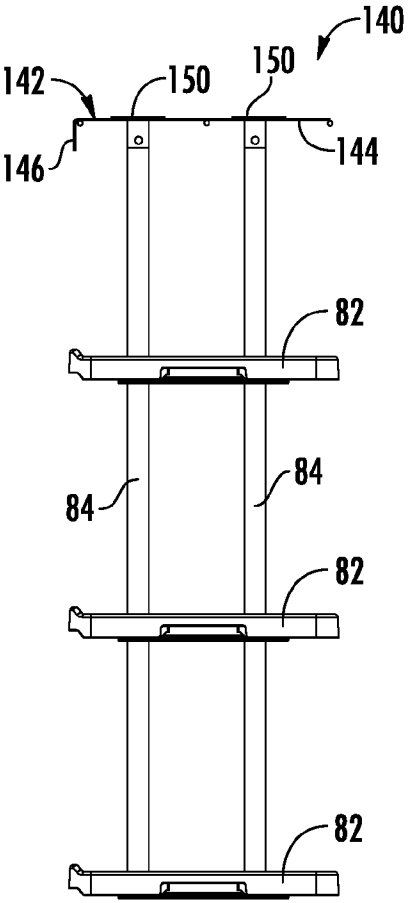
FIG. 19 is a left side view elevation of the shelving system shown in FIG. 16.
Figure 18:
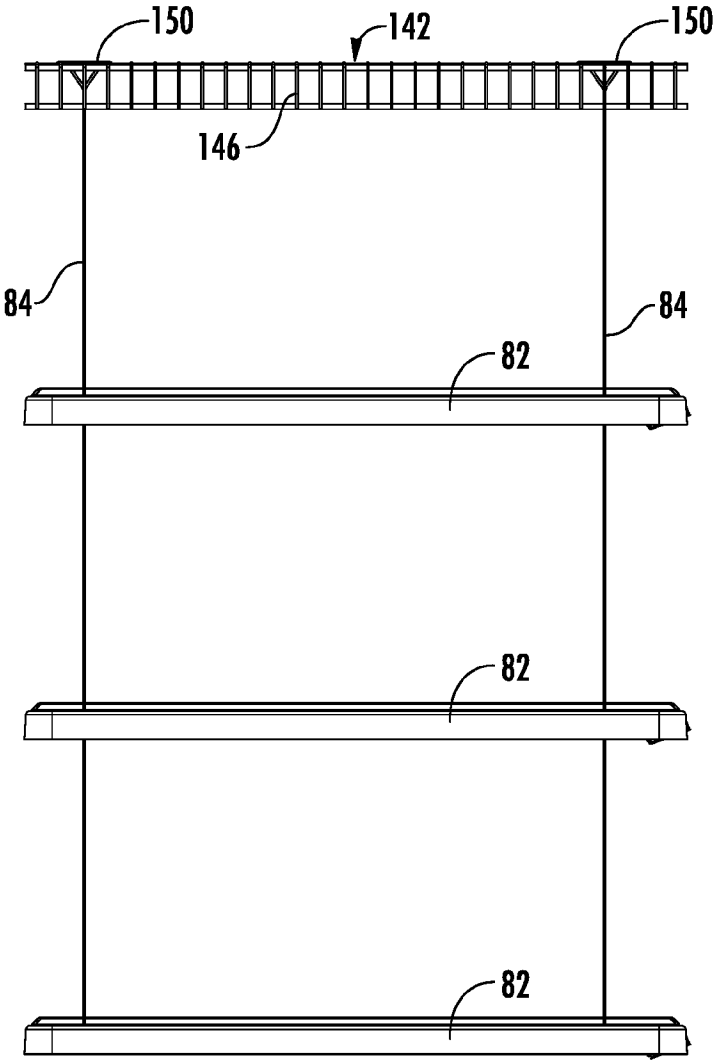
FIG. 18 is a front elevation view of the shelving system shown in FIG. 16.
Figure 20:
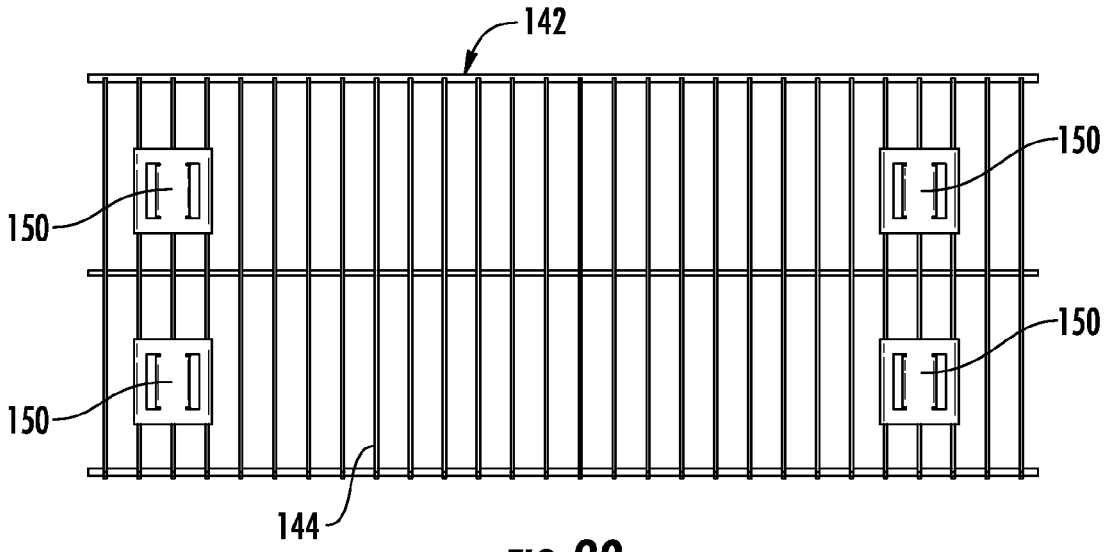
FIG. 20 is a top plan view of the shelving system shown in FIG. 16, with the straps omitted.
Figure 21:
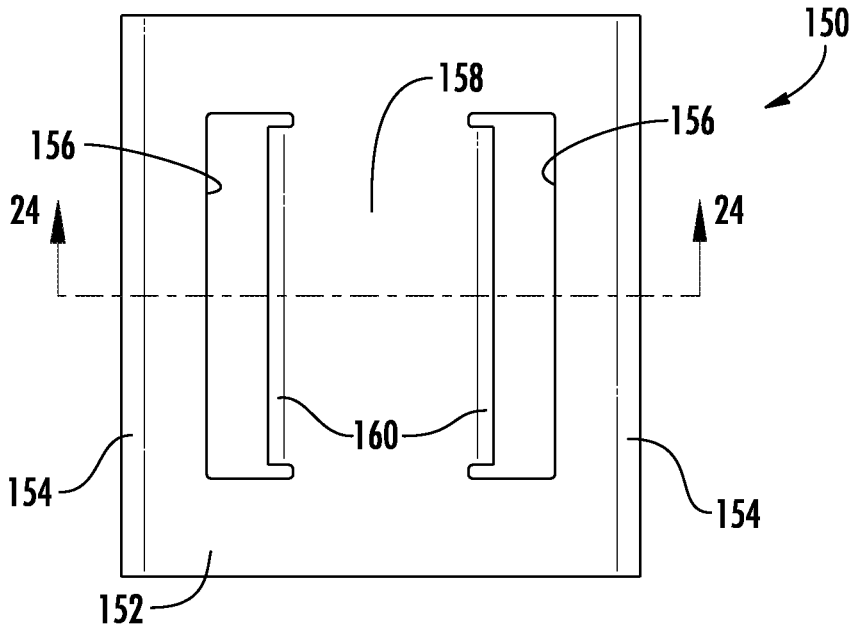
FIG. 21 is a detailed perspective view of the support shelf and the attachment bracket shown in FIG. 16.
Figure 22:
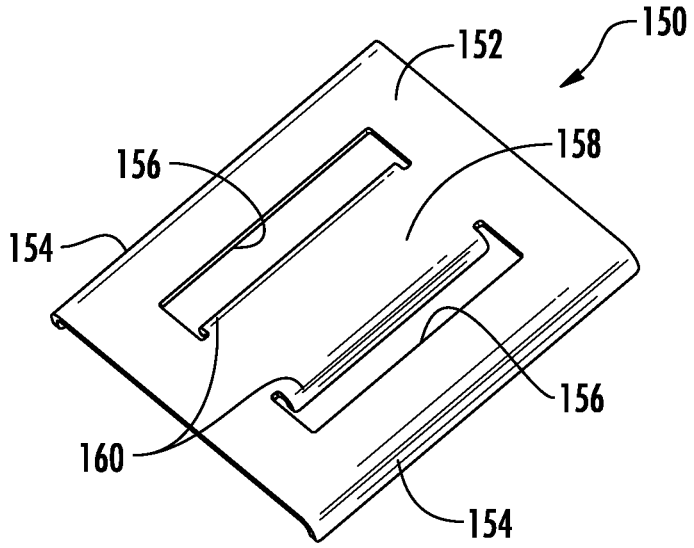
FIG. 22 is a top plan view of the bracket as shown in FIG. 16.
Figure 23:
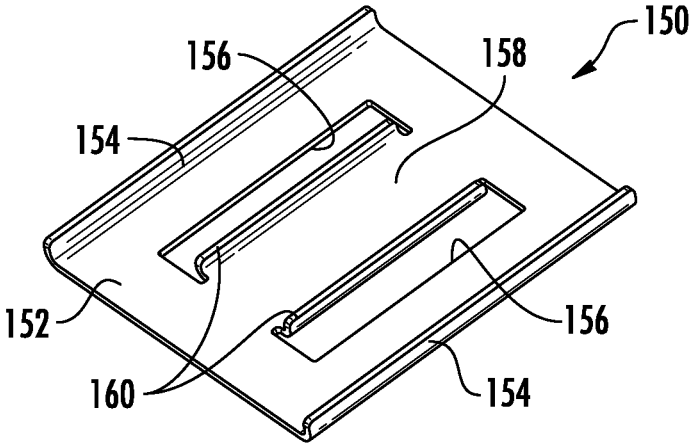
FIG. 23 is a top perspective view of the bracket as shown in FIG. 22.
Figure 24:
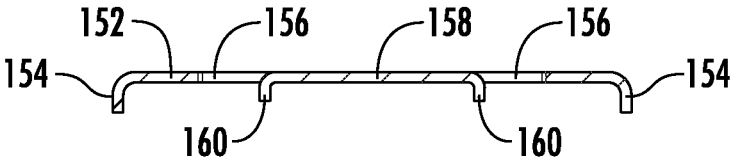
FIG. 24 is a bottom perspective view of the bracket as shown in FIG. 22.

FIGS. 9-15 show a second embodiment of an attachment bracket 110 for mounting to a solid shelf 62. This attachment bracket 110 appears the same as the previous embodiment of an attachment bracket 80 as shown in FIGS. 1, 3, and 5. This attachment bracket 110 likewise is configured to be substantially U-shaped, having a top leg 112, a bottom leg 114, and a front portion 116 connecting the legs 112, 114, all defining an opening 118. FIG. 9 shows the bottom leg 114 of the attachment bracket 110 in position on the shelf 62, and FIG. 10 shows a side elevation view of the system 120, with the straps 84 looping around the bottom leg 114 of the attachment bracket 110. The straps 84 engage the top surface 122 of the bottom leg 114 at recessed areas 124 along the top surface 122 (FIG. 11). In this embodiment of the attachment bracket 110, the strap 84 may be pre-fastened to make a loop in the strap 84 before reaching a user because the recessed areas 124 can be accessed from the free end of the bottom leg 114, as opposed to requiring threading of the strap 84 through slots 94 as in the first embodiment of an attachment bracket 80.

FIGS. 11-15 show the second embodiment of the attachment bracket 110 in detail, which in general has the same configuration and method of mounting to the support shelf 62 as the first embodiment 80. In the second embodiment, however, the top leg 112, front portion 116, and bottom leg 114 are each open channels. The recessed areas 124 may be spaced from front to back of the bottom leg, which again spaces the straps 84 to provide, with two attachment brackets 110 with two recessed areas 124, four points of support for each hanging shelf 82. The attachment bracket 110 may be made of a variety of materials; in the embodiment shown, the attachment bracket 110 may be made of metal and may be formed from a flat, stamped plate and welded or otherwise secured in the desired shape. Materials for this embodiment also may include plastic, or as selected by one of ordinary skill in art.

Another embodiment of a shelving system is shown in FIGS. 16-20, and is generally designated as 140. The system 140 is shown with a wire support shelf 142 mounted to a wall 64, though other mounting configurations, such as to posts or poles, are possible. The system 140 may further includes means of mounting the wire support shelf 140 to the wall 64 that is not shown, such as clips, with support brackets (not shown) mounted to the wall at one end of the support bracket and supporting the free edge of the shelf 142 with the other end of the support bracket. The shelf 142 includes a deck 144 and a front edge 146.

Four wire shelf attachment brackets 150 are positioned on the deck 144 in a substantially rectangular configuration, and hanging shelves 82 are suspended from the attachment brackets 150 with straps 84. The four attachment brackets 150 provide four points of support for the hanging shelves 82 for stability and strength. An attachment bracket 150 is shown in detail in FIGS. 21-24. This embodiment of an attachment bracket 150 shown is substantially a plate with a body 152 having downturned curved edges 154 along two sides and two elongated substantially parallel openings or slots 156 that are substantially parallel to the curved edges 154. The slots 156 are on either side of a center portion 158 of the body 152 and each has on its side proximate to the center of the body 152 downwardly curved lips 160.

Figure 25:
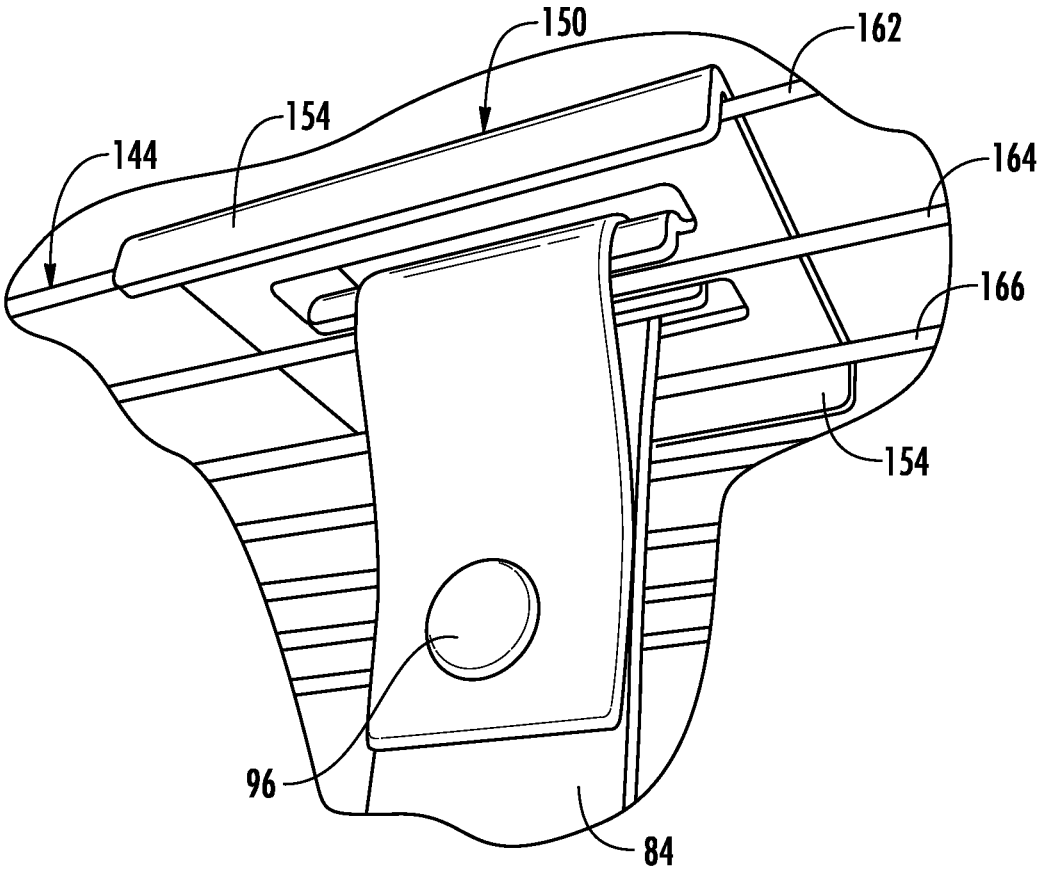
FIG. 25 is a section view of the bracket taken along line 25-25 of FIG. 22.
Figure 26:
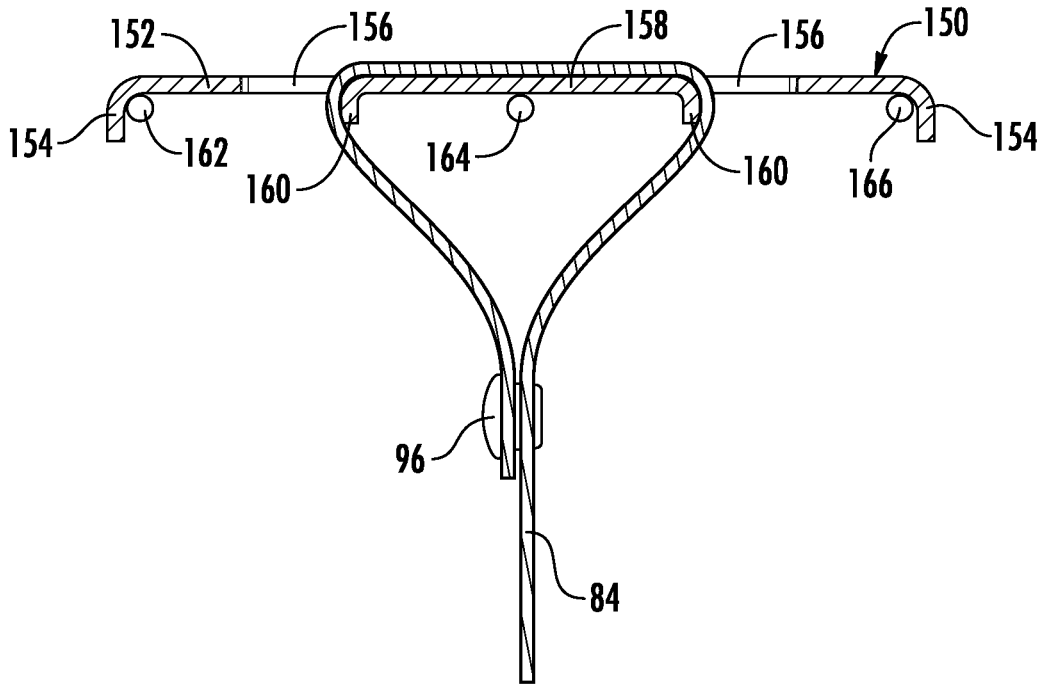
FIG. 26 is a section view taken along line 26-26 of FIG. 16.
Figure 27:
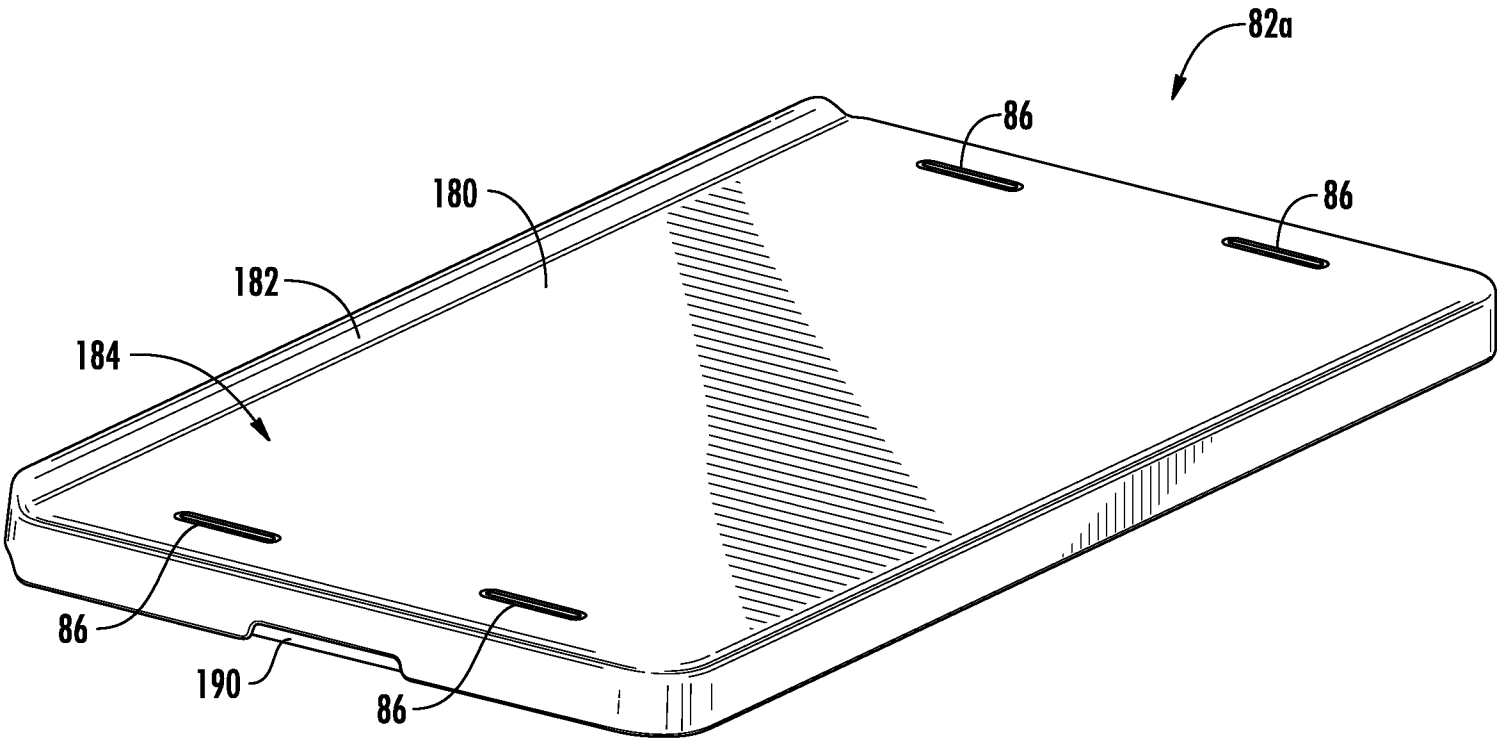
FIG. 27 is a top perspective view of a first embodiment of a shelf shown in the shelving systems of FIGS. 1 and 16.

The straps 84 weave through openings in the attachment brackets 150 as shown in detail in FIGS. 25 and 26. The embodiment of the attachment bracket 150 shown spans three wires 162, 164, 166 of the wire shelf deck 144, where preferably the attachment bracket 150 is centered on the center wire 164. The distance between the curved edges 154 may be set such that the curved edges 154 engage the outside wires 162, 166 and prevent lateral movement of the attachment bracket 150. The attachment bracket 150 could have an offset structure such that the strap 84 is not aligned with the center wire 164. Spanning a plurality of wires increases the stability and strength of the deck support of the straps 84. The separate attachment bracket design permits adjustment from front to back of a support shelf 62, for example, to reduce the distance between the back of a hanging shelf 82 and the wall 64, or to accommodate wider shelves with wider spacing between slots 86.

The lips 160 are shaped to engage the straps 84 with their curved surface, and are threaded through the wire shelf deck 144 and the openings 156 in the attachment bracket 150. Although the center portion 158 of the attachment bracket 150 is shown spanning one wire 164, the center portion could span a plurality of wires. Because the strap 84 has to be threaded through the attachment brackets 150 and wires 162, 164, 166, in this embodiment a user needs to be able to fasten the strap 84 to itself, for example, with a snap 96 or other fastener when assembling the system. Preferably the fastener is releasable to allow relocation or adjustment of the position of the attachment brackets 150 and system 140.

The material of the attachment brackets 80, 110, 150 may generally be expected to be metal, such as a low carbon steel or other steel alloy, or alternatively may be a plastic, and may be high strength polymer and/or include carbon reinforcing, but may be other metals or materials as selected by one of ordinary skill in the art. Methods of manufacture may include, but not be limited to, injection molding, die casting, sand casting, or extrusion. If metal, a surface treatment may be applied for corrosion protection, for example, a zinc coating by a barrel plating process, galvanizing, or a powder based epoxy or paint coating, or as otherwise selected by one of ordinary skill in the art.

Figure 28:
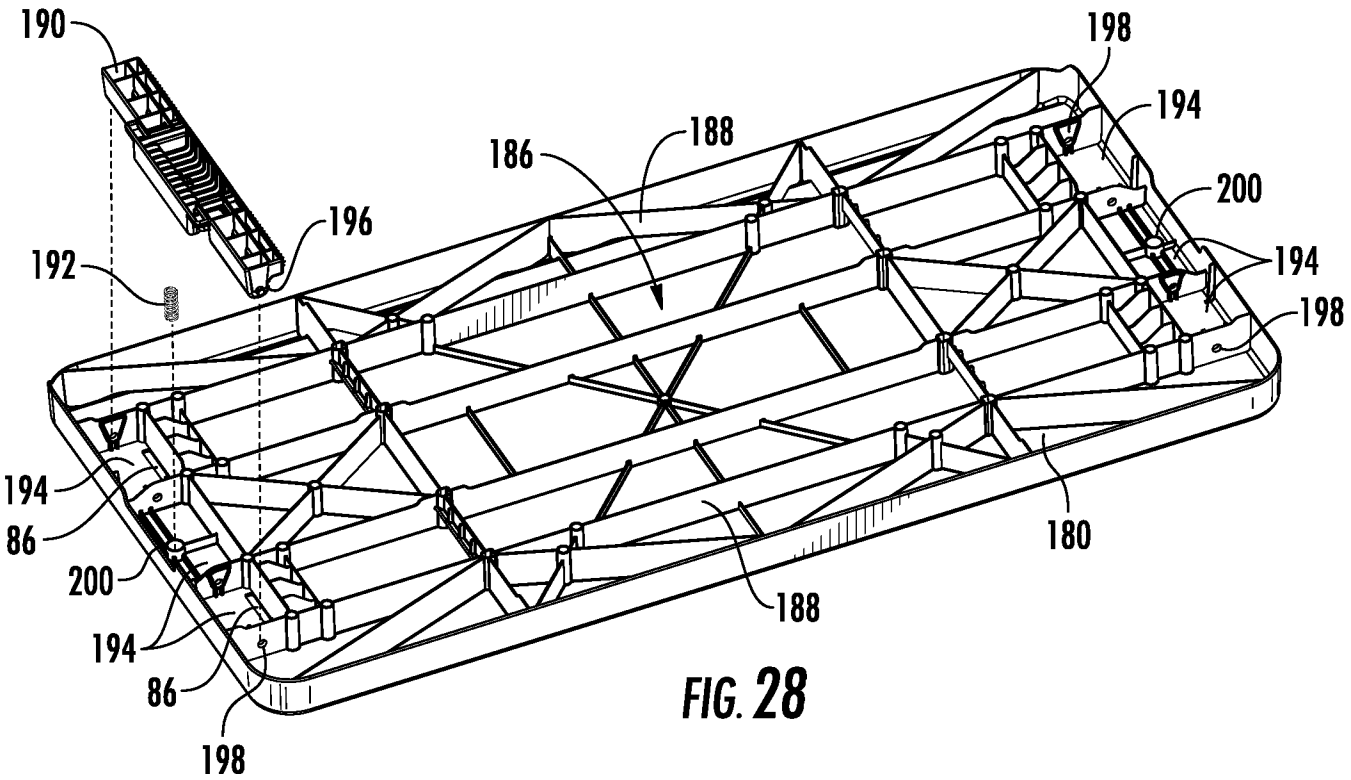
FIG. 28 is an exploded bottom perspective view of the shelf shown in FIG. 27, including a first embodiment of a clamp.
Figure 29:
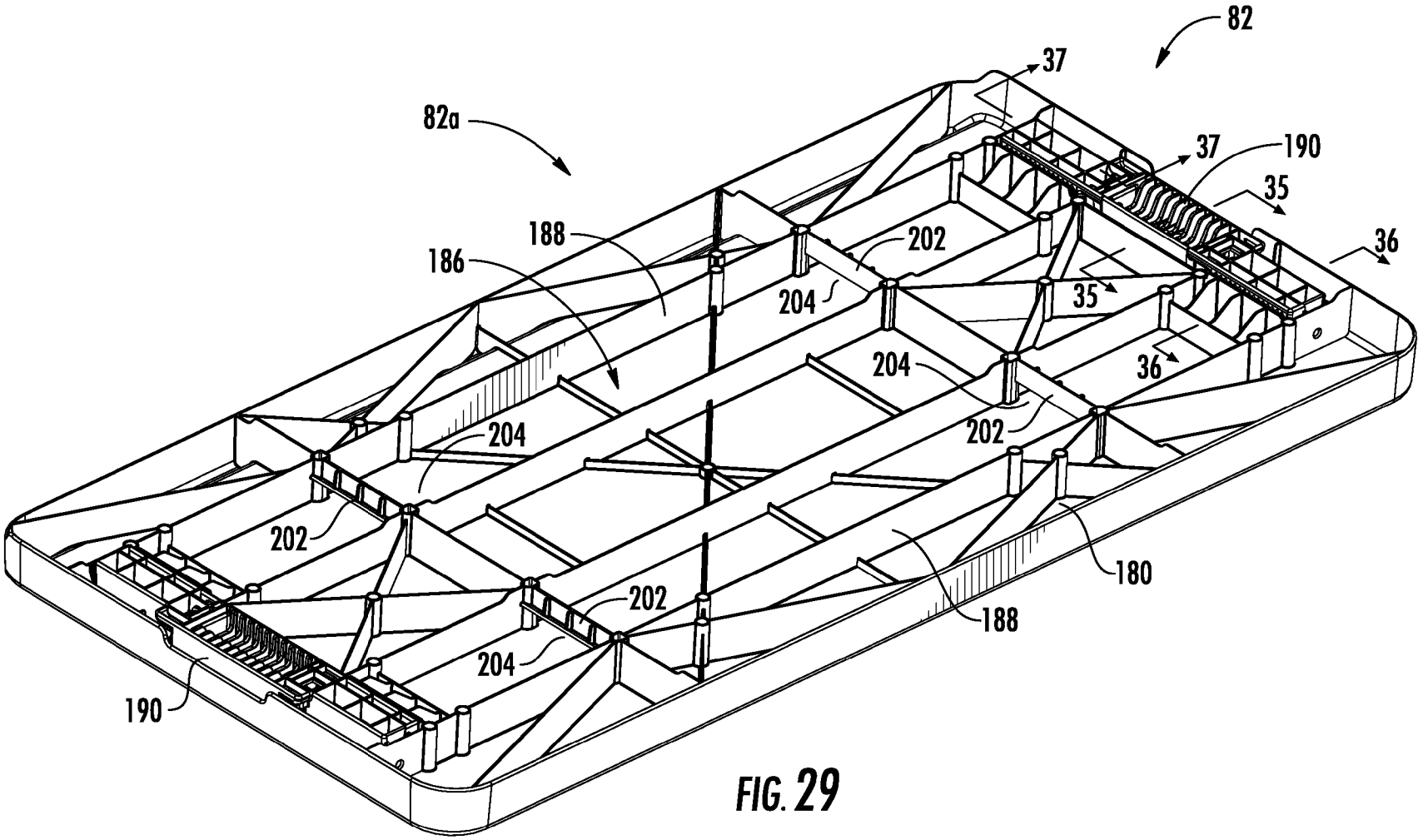
FIG. 29 is a bottom perspective view of the shelf shown in FIG. 27.

FIGS. 27-37 show a first embodiment and components of a hanging shelf 82*a* that may be used as the shelf 82 in the shelving systems 60, 120, 140 described above, or in other shelving systems that employ straps to hang the shelves. The hanging shelf 82*a* has a deck 180 that is substantially rectangular in plan view, but may be other shapes, and has an optional lip 182 at the rear edge to help keep articles on the top surface 184. Four or another plurality of slots 86 may be provided for receiving straps 84 from which the shelf 82 is suspended. FIG. 28 shows the bottom surface 186 of the deck 180 with stiffener ribs 188, a clamp 190, and a spring 192 for biasing the clamp 190 to the closed, engaged position. The clamp 190 is received in openings 194 in the deck 180, and has round pivot protrusions or pivot bosses 196 that are received in openings 198 in the ribs 188. The spring 192 is received in a cylindrical opening 200 in the deck. Another clamp 190 will be placed at the opposite end of the deck 180, as shown in FIG. 29. The straps 84 pass through the slots 86 to allow hanging of one shelf 82*a* beneath another shelf 82*a*, as shown in, for example, FIGS. 1 and 16.

As shown in FIG. 29, several ribs 202 extend across the deck 180 between other ribs 188, but are not in contact with the bottom surface 186 of the deck 180. As such, these ribs 202, which may be formed by a slide in an injection mold, provide a location for storage of the straps 84 in transit or excess strap length in usage, which may be folded and tucked in these areas 204 between the ribs 202 and the bottom surface 186 of the deck 180.

Figure 30:
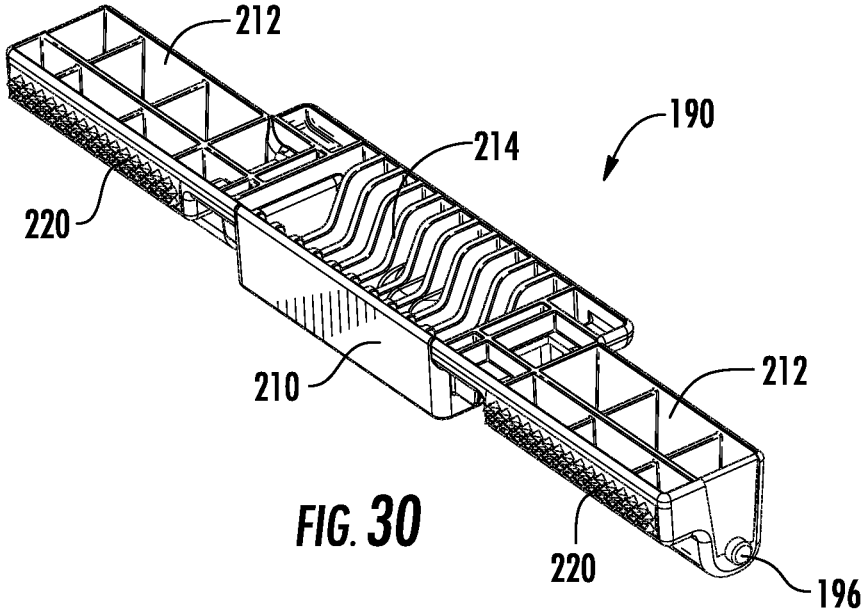
FIG. 30 is a bottom perspective view of the clamp shown in FIG. 28.
Figure 31:
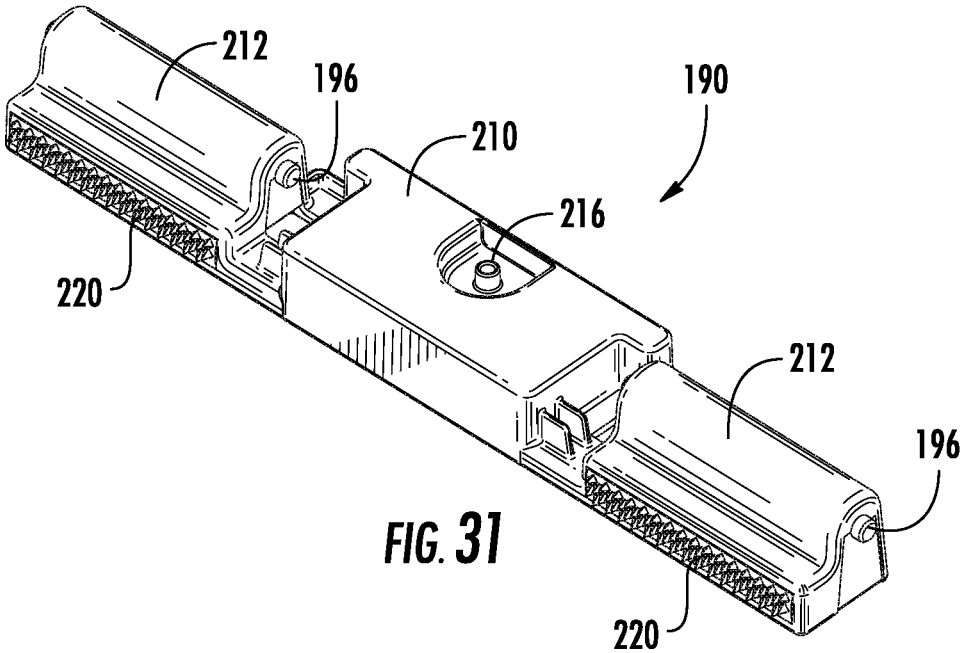
FIG. 31 is a top perspective view of the clamp shown in FIG. 28.
Figure 32:
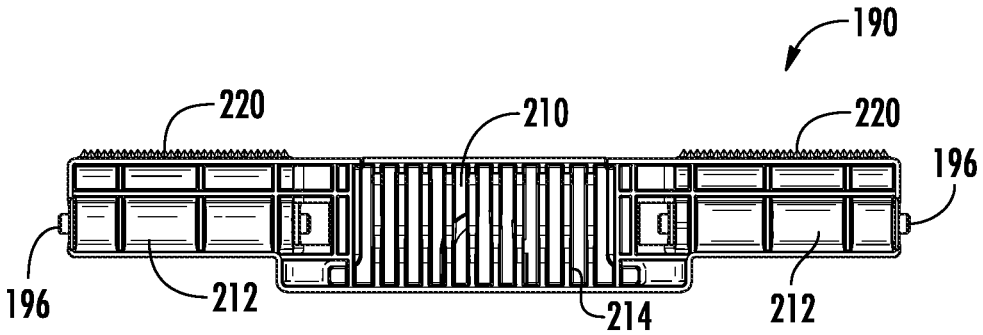
FIG. 32 is a bottom plan view of the clamp shown in FIG. 28.
Figure 33:
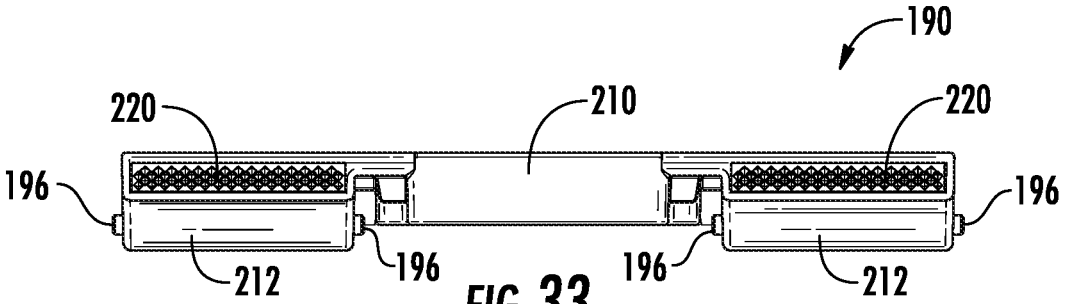
FIG. 33 is a front elevation view of the clamp shown in FIG. 28.
Figure 34:
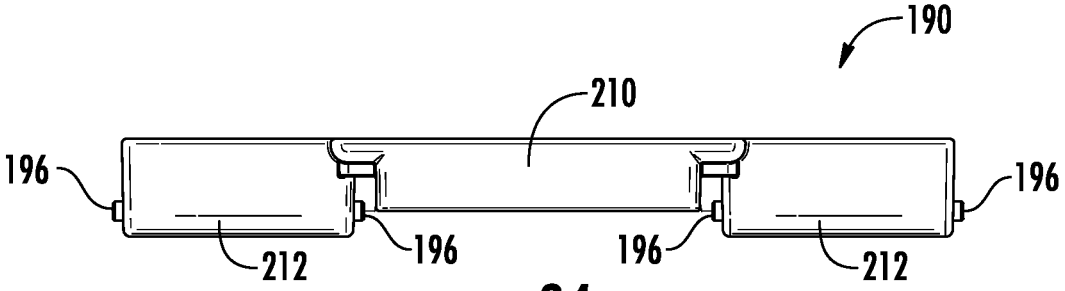
FIG. 34 is a rear elevation view of the clamp shown in FIG. 28.

FIGS. 30-34 show this first embodiment of a clamp 190 in detail. The view of FIG. 30 shows the bottom and front of the clamp 190, while FIG. 31 shows the top and front of the clamp 190. The bottom of the clamp 190 is the side that will be facing downward when received in the deck 180. The clamp 190 includes a handle portion 210 and two gripping portions 212. The pivot bosses 196 are provided on each side of the gripping portions 212 and secure the clamp 190 into the deck 180. The handle portion 210 includes a sloped section with an angled interaction surface 214 as an ergonomic design for hand placement. A round spring protrusion 216 is provided for receiving the spring 192 towards the back of the handle portion 210. The gripping portions 212 each include a toothed section 220 that will engage a strap 84 that passes through the adjacent slot 86. By placing the interaction surface 214 of the clamp 190 at least under the clamp's pivot point (the pivot bosses 196) or inside the pivot point toward the center of the shelf 82*a*, a user's application of force to the interaction surface 214 results in a torque being applied to open the mechanism and release the straps 84. If the interaction surface 214 were far away from the pivot point, such that the clamp 190 was biased away from the deck 180, a user would generate a torque opposite to the closing direction of the clamp 190. To allow the clamp 190 to close on the strap 84, the user would have to temporarily have to let go of the shelf 82*a*, causing the shelf 82*a* to fall slightly and result in an unsettling feeling for the user.

Figure 35:
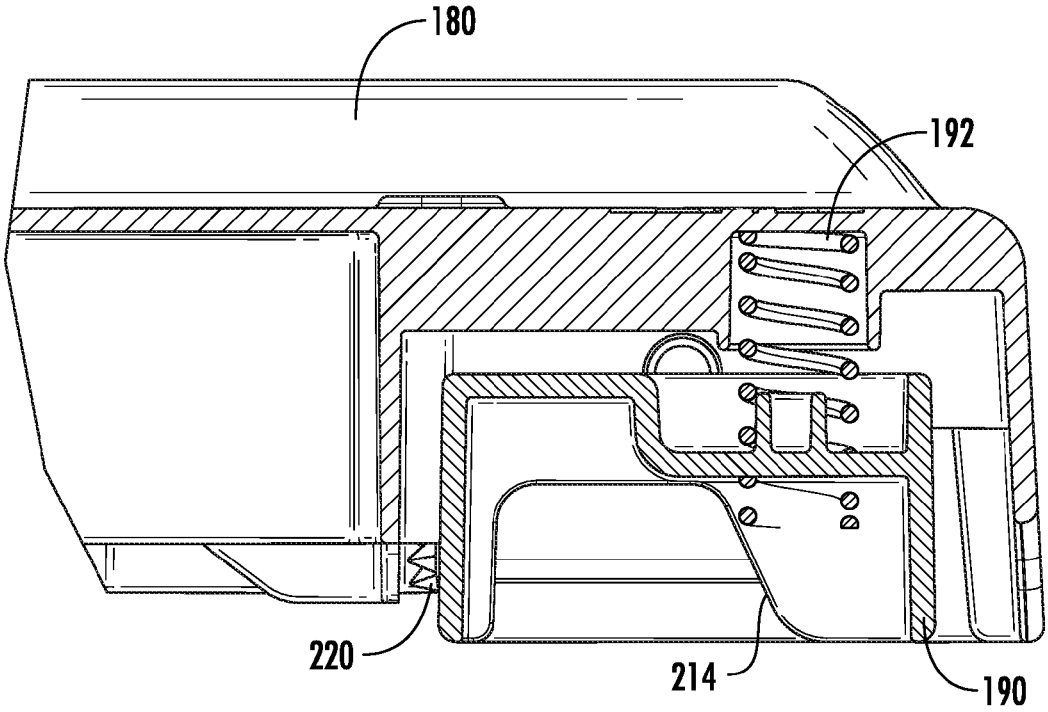
FIG. 35 is a section view taken along line 35-35 of FIG. 29.
Figure 36:
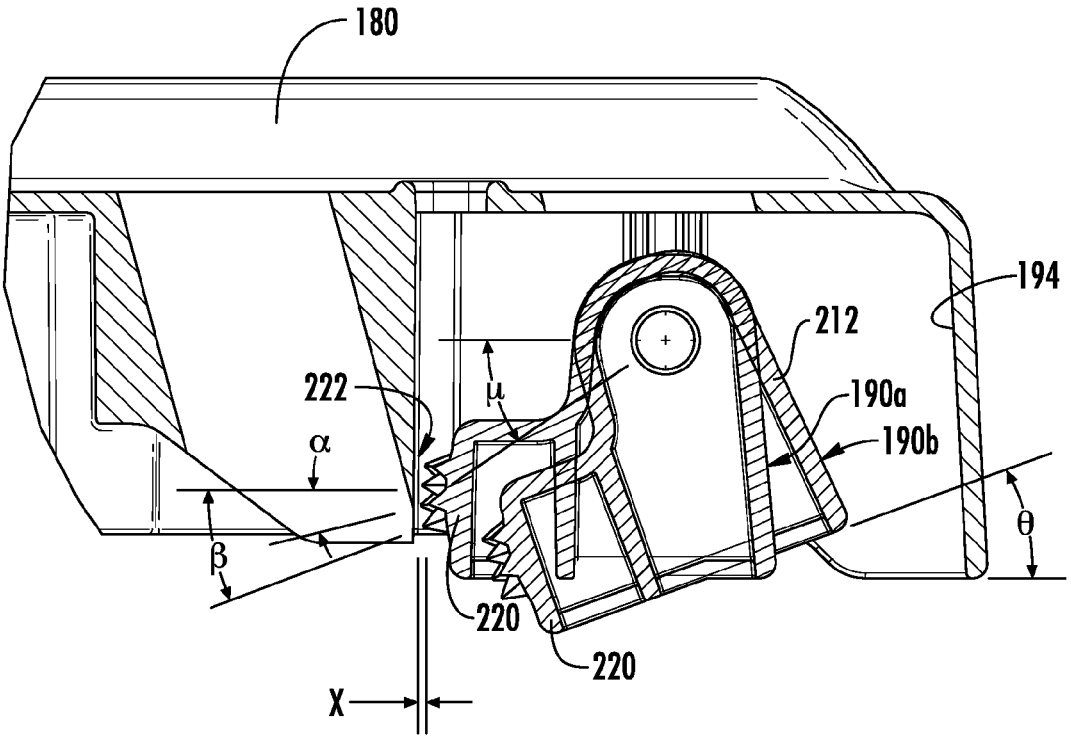
FIG. 36 is a section view taken along line 36-36 of FIG. 29.

FIG. 35 shows a section of the clamp through the handle portion 210 at the center where the spring 192 is located. As discussed above, the spring 192 is received in a cylindrical opening 200 in the deck 180, and around a round spring protrusion 216 of the handle portion 210 proximate to the back of the handle portion 210. The position of the spring 192 causes the clamp 190 to be biased to the engaged position, as shown in FIG. 35. FIG. 36 shows a section of the clamp 190 through the gripping portion 212, with the clamp 190 in both the closed, engaged position 190*a* and the open, disengaged position 190*b*. An engagement surface 222 is provided on the deck 180 that opposes the toothed section 220 when the clamp 190 is in the engaged position 190*a*. When in the engaged position 190*a*, the toothed section 220 engages the strap 84, and the downward force of the weight of the shelf 82*a* and the articles on the shelf 82 causes the toothed section 220 of the clamp 190 to rotate upward, tightening the mechanism and increasing the "bite" into the strap 84. The strap 84 is clamped, or pinned, between the engagement surface 222 and the toothed section 220 of the clamp 190.

In one embodiment, dimensions and angles may be as follows. The clearance X between the teeth 230 and the engagement surface 222 may be approximately at least 0.02 inches, or preferably 0.023 inches, and may be adjusted based on the thickness and material of the strap 84. The angle of rotation θ of the bottom of the gripping portion 212 from horizontal may be approximately 20 degrees. The angle μ which is the angle from the axis of rotation of the clamp 190 to the vertical center of the toothed portion 220 may be approximately 34 degrees, or preferably 34.1 degrees. The angles α and β of the main contact teeth, which may be considered to be the bottom two teeth, from horizontal may be respectively approximately 10 and 20 degrees.

Figure 37:
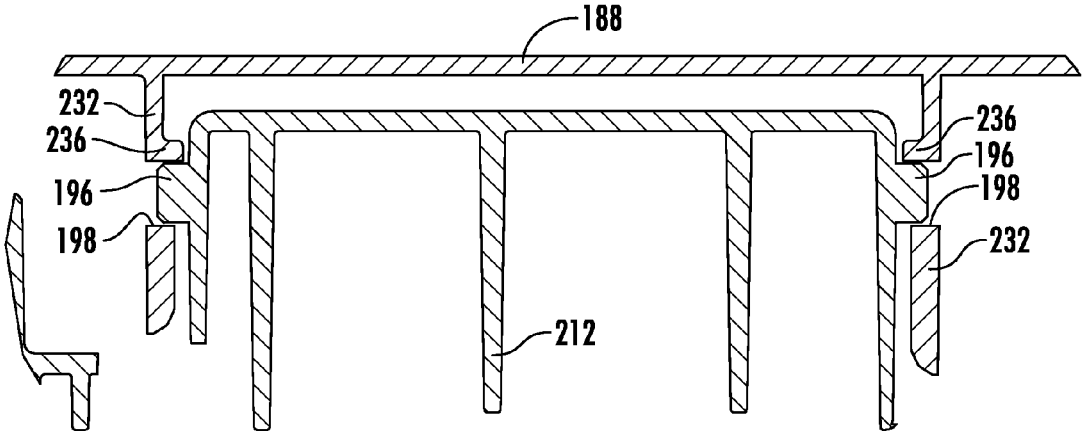
FIG. 37 is a section view taken along line 37-37 of FIG. 29.
Figure 38:
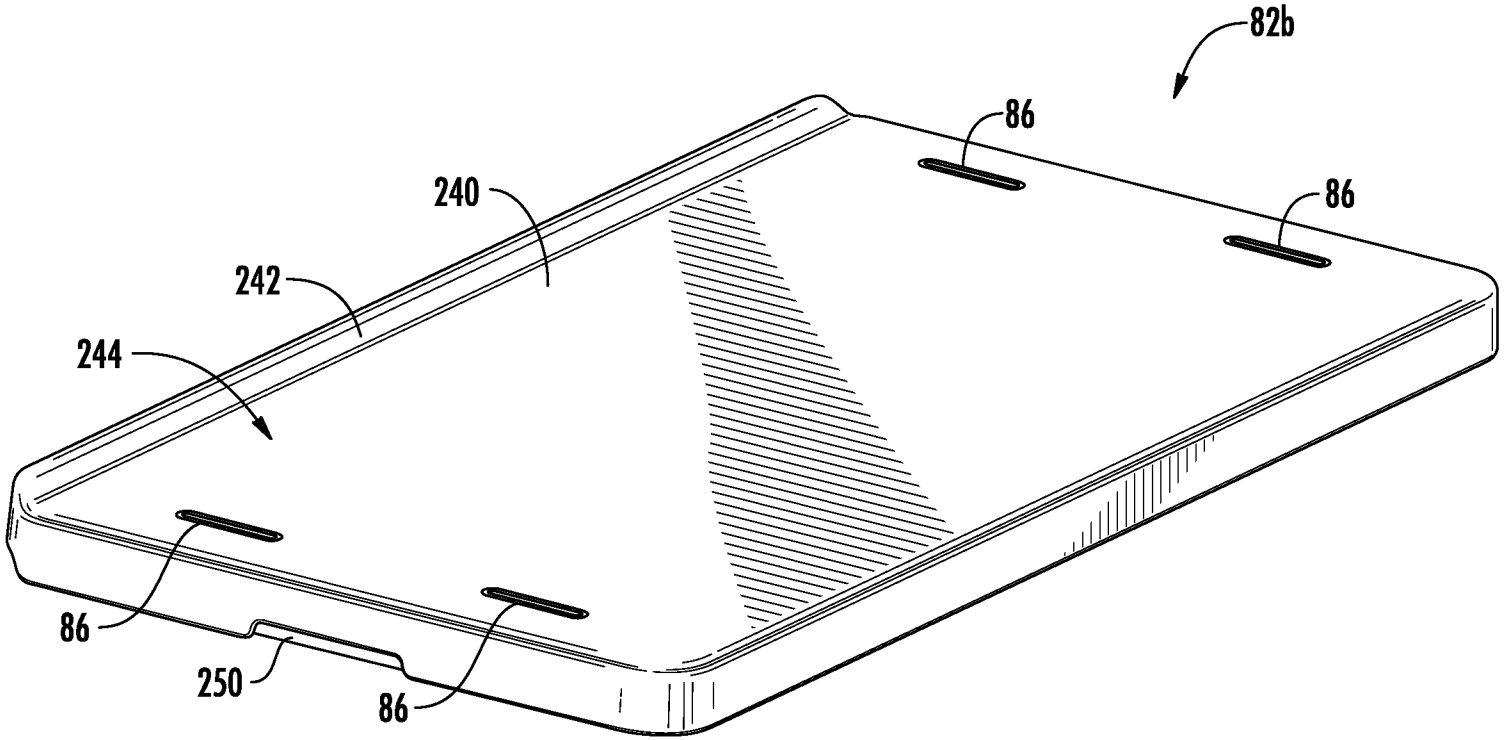
FIG. 38 is a top perspective view of a second embodiment of a shelf shown in the shelving systems of FIGS. 1 and 16.

FIG. 37 shows the mounting of the clamp 190, and specifically a gripping portion 212 in the deck 180. Ribs 232 on each side of the gripping portion 212 define openings 198 that receive the pivot bosses 196 of the gripping portion 212, where the pivot bosses 196 snap into place by slight deflection of the ribs 232. At their free edges, the ribs 232 are configured to have a progressive ramp design 234 to facilitate entry of the pivot bosses 196 between the ribs 232. A shelf feature 236 on each side is provided for extra engagement of the openings 198 with the clamp' pivot bosses 196. This three-dimensional geometry may be molded by using slides in an injection mold, which allows the ribs to be thickened locally. Rib thickening allows a longer ramp 234 to be used on the shelf rib 232 to guide the clamp 190 into place. Resulting from the thicker wall, the engagement can be increased between the ribs 232 of the shelf and the pivot bosses 196, which prevents issues that can result from tight tolerance.

Figure 39:
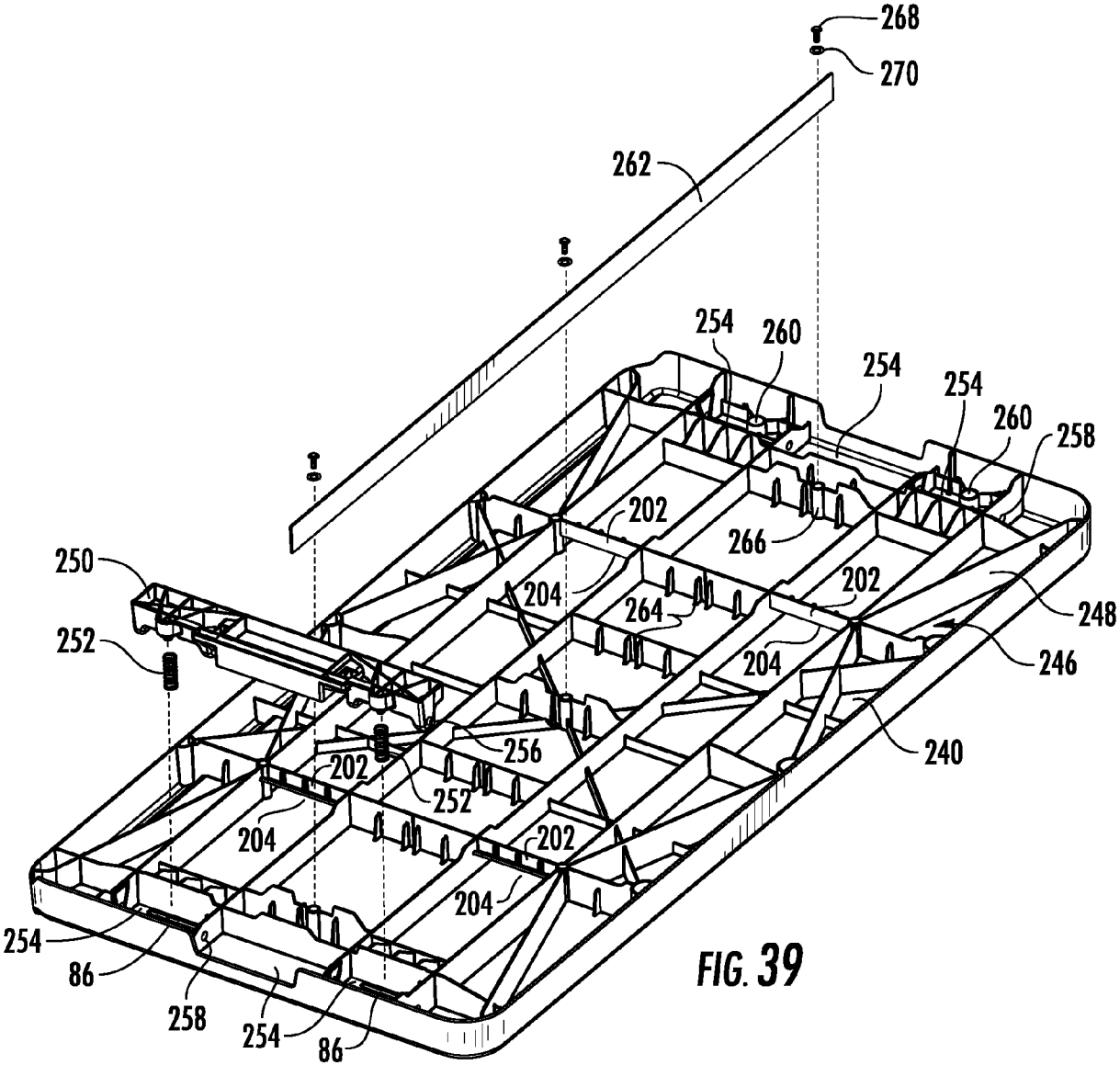
FIG. 39 is an exploded bottom perspective view of the shelf shown in FIG. 38, including a second embodiment of a clamp.

FIGS. 38-45 show a second embodiment and components of a hanging shelf 82*b* that may also be used as a shelf 82 in the shelving systems 60, 120, 140 described above, or in other shelving systems that employ straps to hang the shelves. The hanging shelf 82*b* has a deck 240 that is substantially rectangular in plan view, but may be other shapes, and has an optional lip 242 at the rear edge to help keep articles on the top surface 244. Four or another plurality of slots 86 may be provided for receiving straps 84 from which the shelf 82*b* is suspended. FIG. 39 shows the bottom surface 246 of the deck 240 with stiffener ribs 248, a clamp 250, and two springs 252 for biasing the clamp 250 to the closed, engaged position. The clamp 250 is received in openings 254 in the deck 240, and has round pivot protrusions or pivot bosses 256 that are received in openings 258 in the ribs 248. The springs 252 are received in cylindrical openings 260 in the deck (similar openings are visible and labeled at the opposite end of the deck). Increasing the number of springs 252 to two per clamp 250 helps to provide additional consistency in the retention of straps 84 from one side to the other. Another clamp 250 will be placed at the opposite end of the deck 240. The straps 84 pass through the slots 86 to allow hanging of one shelf 82*b* beneath another shelf 82*b*, as shown in, for example, FIGS. 1 and 16.

Figure 40:
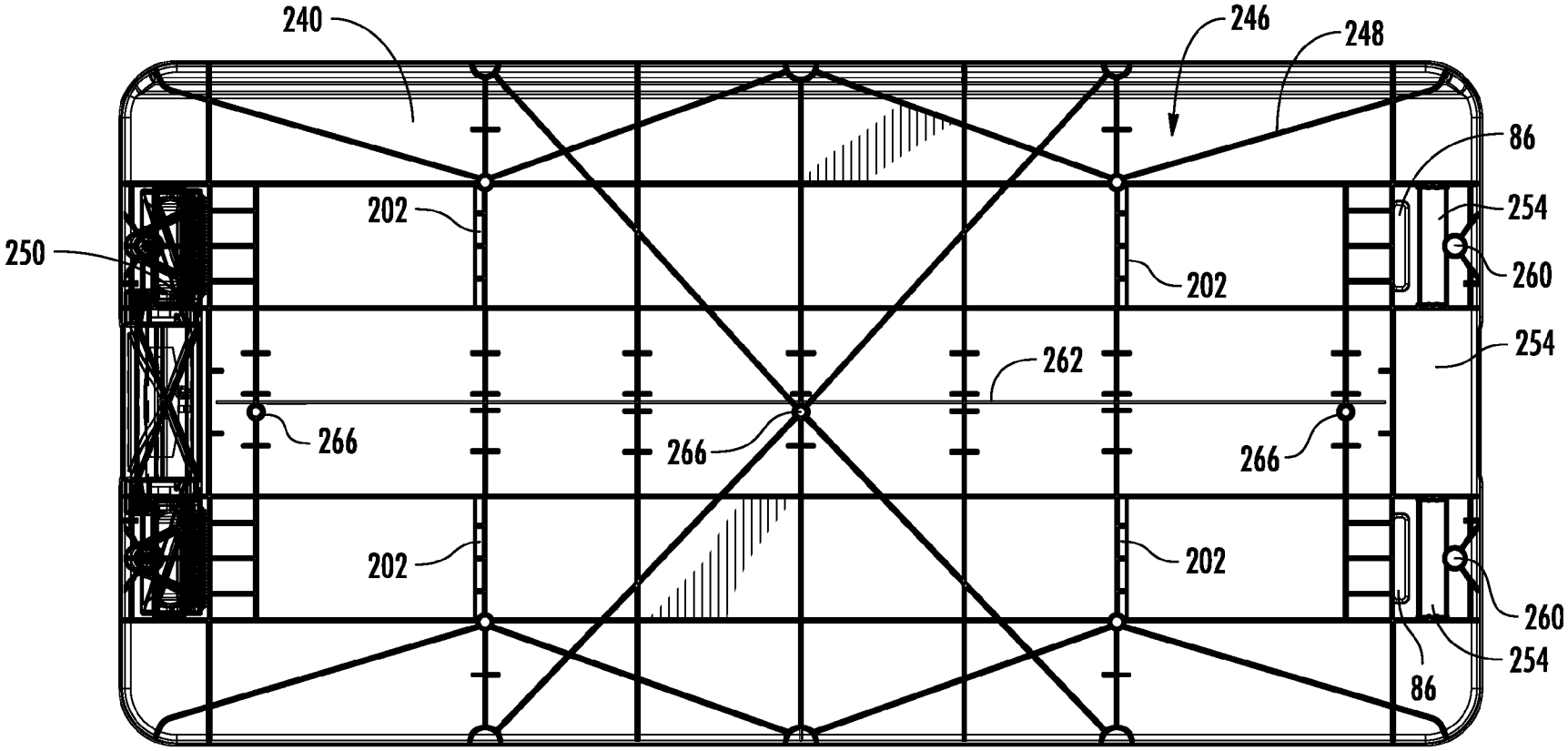
FIG. 40 is a bottom plan view of the shelf shown in FIG. 38.

Elongated strip 262 is provided on the longitudinal axis of the shelf 82*b*. The strip 262 may be, for example, galvanized metal, such as steel. The strip 262 is oriented with its width substantially perpendicular to the top surface 244 of the deck 240 to provide the greatest stiffening effect in the direction of weight bearing on the shelf 82*b*, as well as resistance to creep over time. The strip extends between the clamps 250 in slots 264 in the ribs 248. Cylindrical openings 266 are provided in the middle and at the ends of the strip 262 to receive screws 268. Washers 270 go around the screws and overlap the bottom (top in FIG. 39 orientation) of the strip 262 to secure the strip 262 in the slots 264. Additional strips could be added in various directions to increase the stiffening effect, and the placement of the strips may vary from the central longitudinal axis position shown. A composite shelf with one or more metal strips that act as a beam and that may thereby increase the stiffness of the shelf may provide support for articles with reduced vertical deflection as compared to, for example, an entirely plastic shelf. FIG. 40 further shows the layout of the deck 240, clamp 250 (only one shown), stiffener ribs 248, and strip 262.

Figure 41:
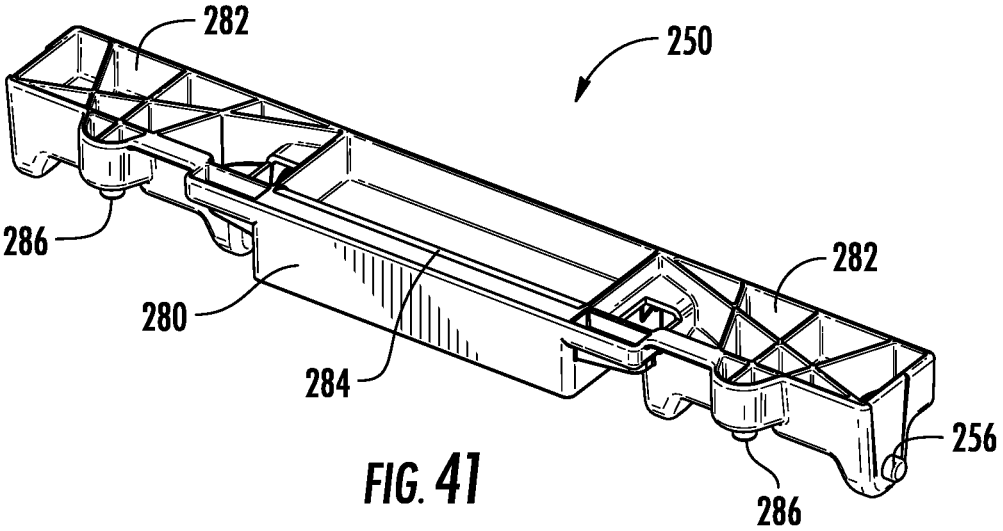
FIG. 41 is a bottom perspective view of the clamp shown in FIG. 39.
Figure 42:
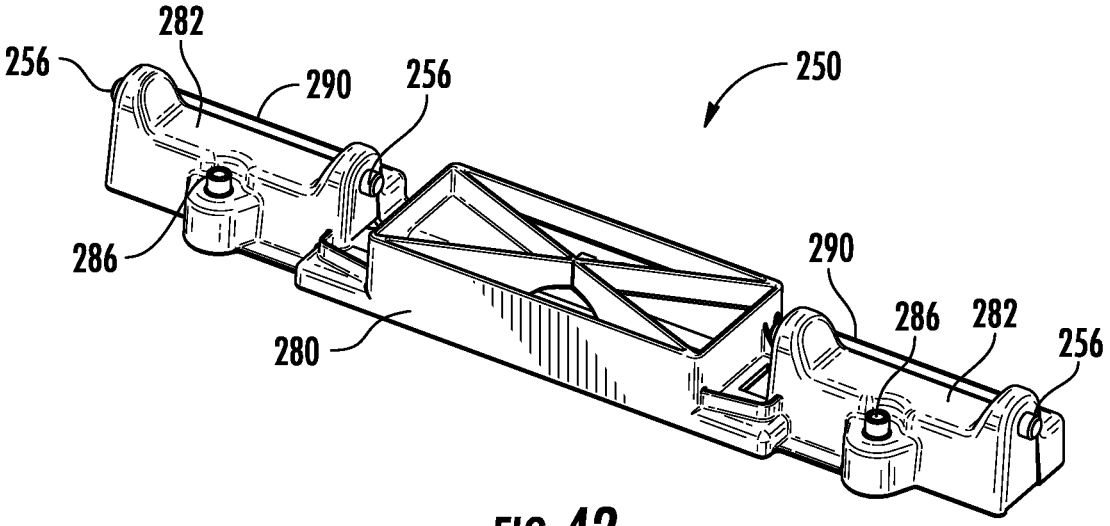
FIG. 42 is a top perspective view of the clamp shown in FIG. 39.
Figure 43:
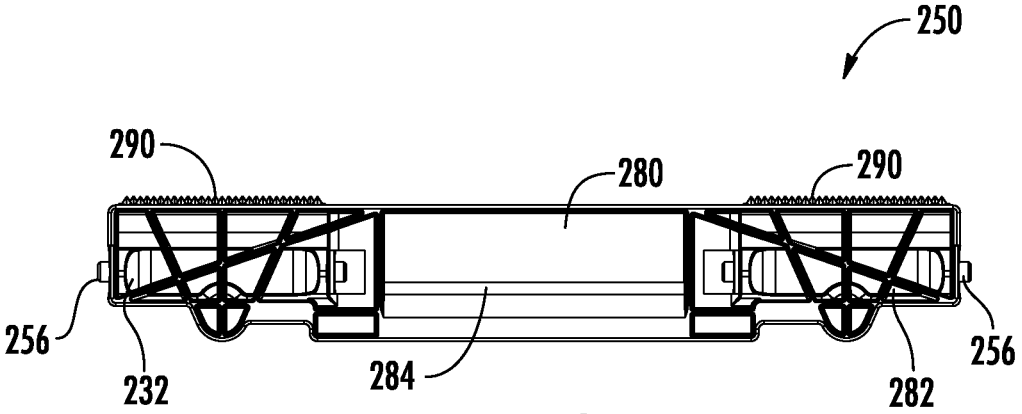
FIG. 43 is a bottom plan view of the clamp shown in FIG. 39.
Figure 44:
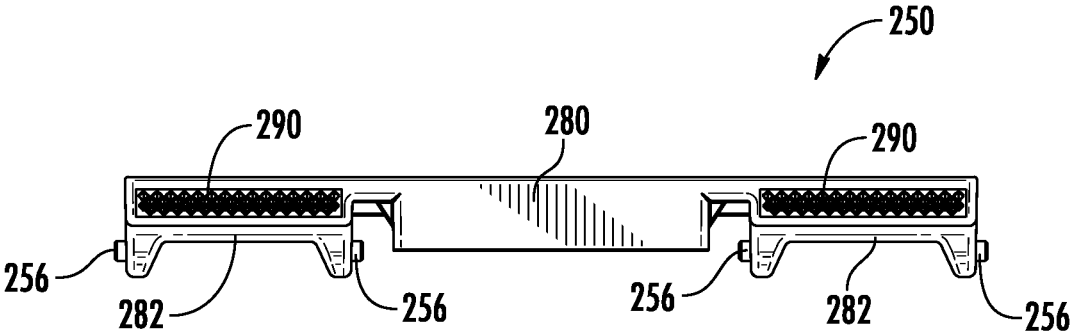
FIG. 44 is a front elevation view of the clamp shown in FIG. 39.
Figure 45:
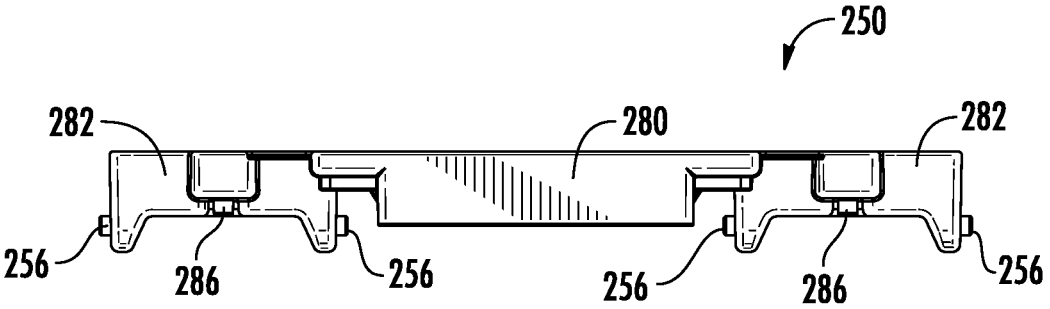
FIG. 45 is a rear elevation view of the clamp shown in FIG. 39.

FIGS. 41-45 show the second embodiment of a clamp 250 in detail. The view of FIG. 41 shows the bottom and rear of the clamp 250, while FIG. 42 shows the top and rear of the clamp 250. The bottom of the clamp 250 is the side that will be facing downward when received in the deck 240. The clamp 250 includes a handle portion 280 and two gripping portions 282. The pivot bosses 256 are provided on each side of the gripping portions 282 and secure the clamp 250 into the deck 240. The handle portion 280 includes a sloped section with an angled interaction surface 284 as an ergonomic design for hand placement. Round spring protrusions 286 are provided for receiving the springs 252 towards the back of the handle portion 280. The gripping portions 282 each include a toothed section 290 that will engage a strap 84 that passes through the adjacent slot 86. As with the first embodiment of a clamp 190, by placing the interaction surface 284 of the clamp 250 at least under the clamp's pivot point (the pivot bosses 256) or inside the pivot point toward the center of the shelf 82*b*, a user's application of force to the interaction surface 284 results in a torque being applied to open the mechanism and release the straps 84.

The construction and positioning of the clamp 250 may be substantially similar to that of the first embodiment of the clamp 190 as shown in FIGS. 35-37, with one difference being the number and locations of the springs 192, 252.

The decks 180, 240 and clamps 190, 250 may be made of a variety of materials, including but not limited to metal and plastic, but in the embodiment shown are contemplated to be molded plastic, including but not limited to acrylonitrile butadiene styrene (ABS), polyethylene, polypropylene, talc filled polypropylene (PP talc), polyvinyl chloride (PVC), polyoxmethylene (POM), styrene acrylonitrile (SAN), or other polymer. Methods of making the clamp 190, 250 may include injection molding for plastic, and die casting for metal, or formed metal. The springs 192, 252 which could include but not be limited to torsional or tension springs, are shown as metal, in particular steel alloy, but could be another metal, a composite, or plastic. Additional materials and manufacturing methods for these parts may also be as selected by one of ordinary skill in the art. The straps 84 may be made of polyester, nylon, cotton webbing, or any other material that permits engagement with the teeth of the clamp, also as selected by one of ordinary skill in the art.

In the embodiments shown, the shelf 82 provides four points of support to receive four straps 84 spaced for stability and strength in hanging the shelf 82. The height of each shelf 82 may be easily adjusted, with the clamp 190 at each end of the shelf 82 allowing for gripping and release of two straps 82. Only one hand is required to simultaneously release the two straps 84 on each end of a shelf 82. When a user presses on the angled interaction surface 214 of the handle portion 210, the toothed portion 220 of the gripping portion 212 rotates away from the engagement surface 222 of the deck 180 and the strap 84, freeing the strap 84 to slide within the slot 86. The shelves 82 may be adjusted such that the top surface 184 of the deck 180 is horizontal, or alternatively, the straps 84 may be secured to provide an angled surface, as may be desirable for shoe storage. The systems 60, 120, 140 may be applied to a new support shelf installation or retro-fit to an existing installation.

Figure 46:
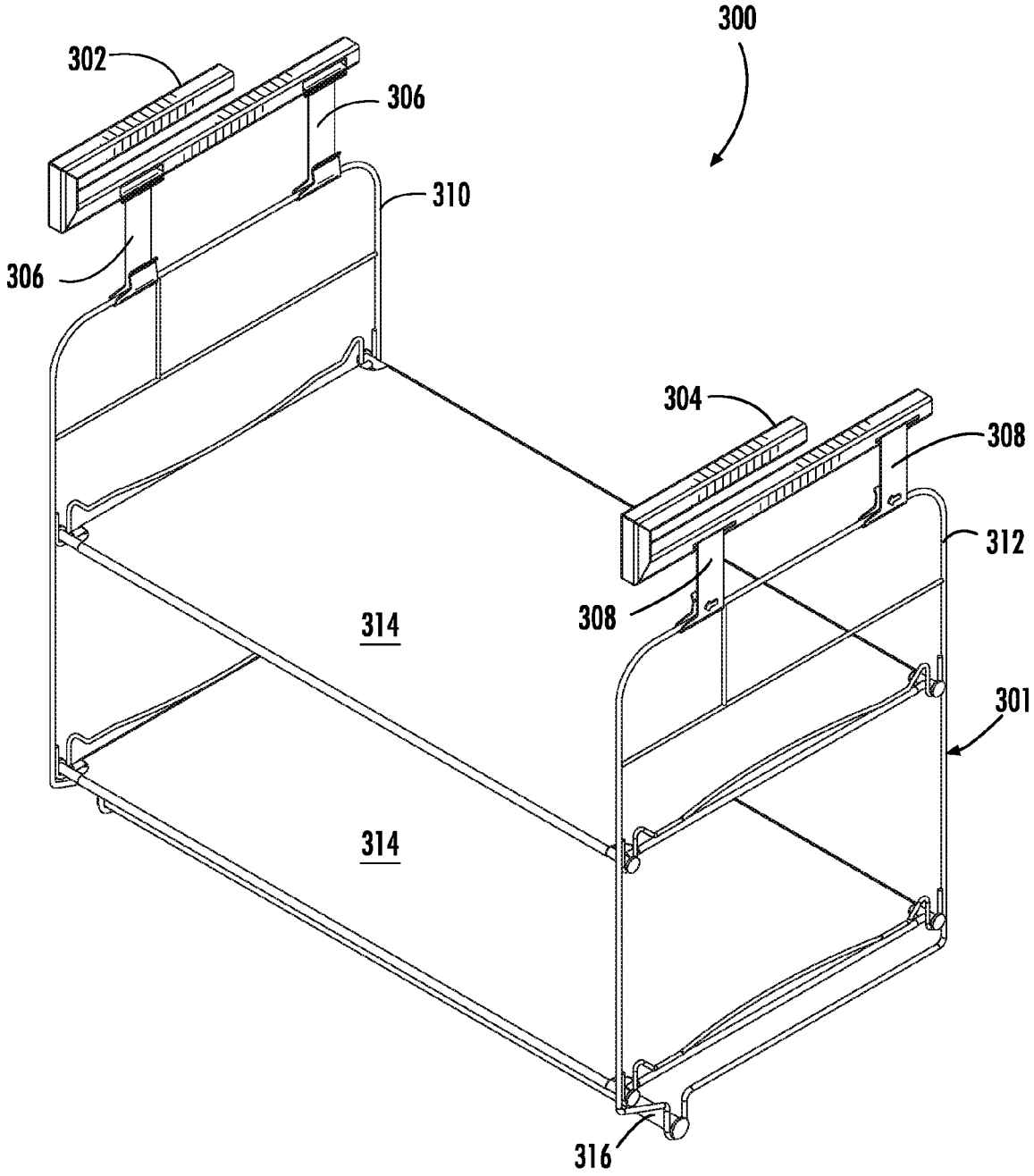
FIG. 46 is a perspective view from above of another embodiment of a shelving system including attachment brackets for a solid surface support shelf.
Figure 47:
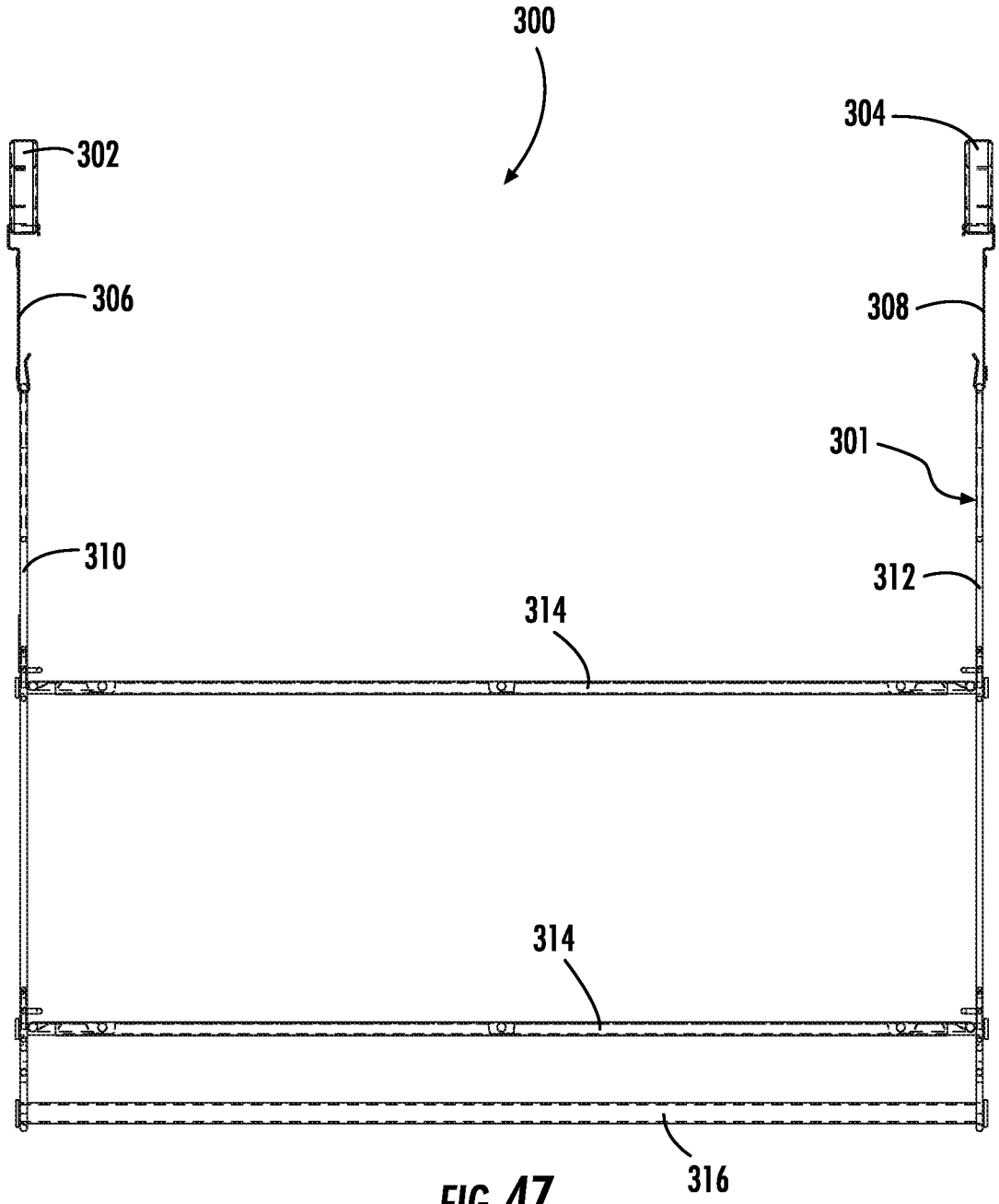
FIG. 47 is a front elevation of view of the shelving system shown in FIG. 46.
Figure 48:
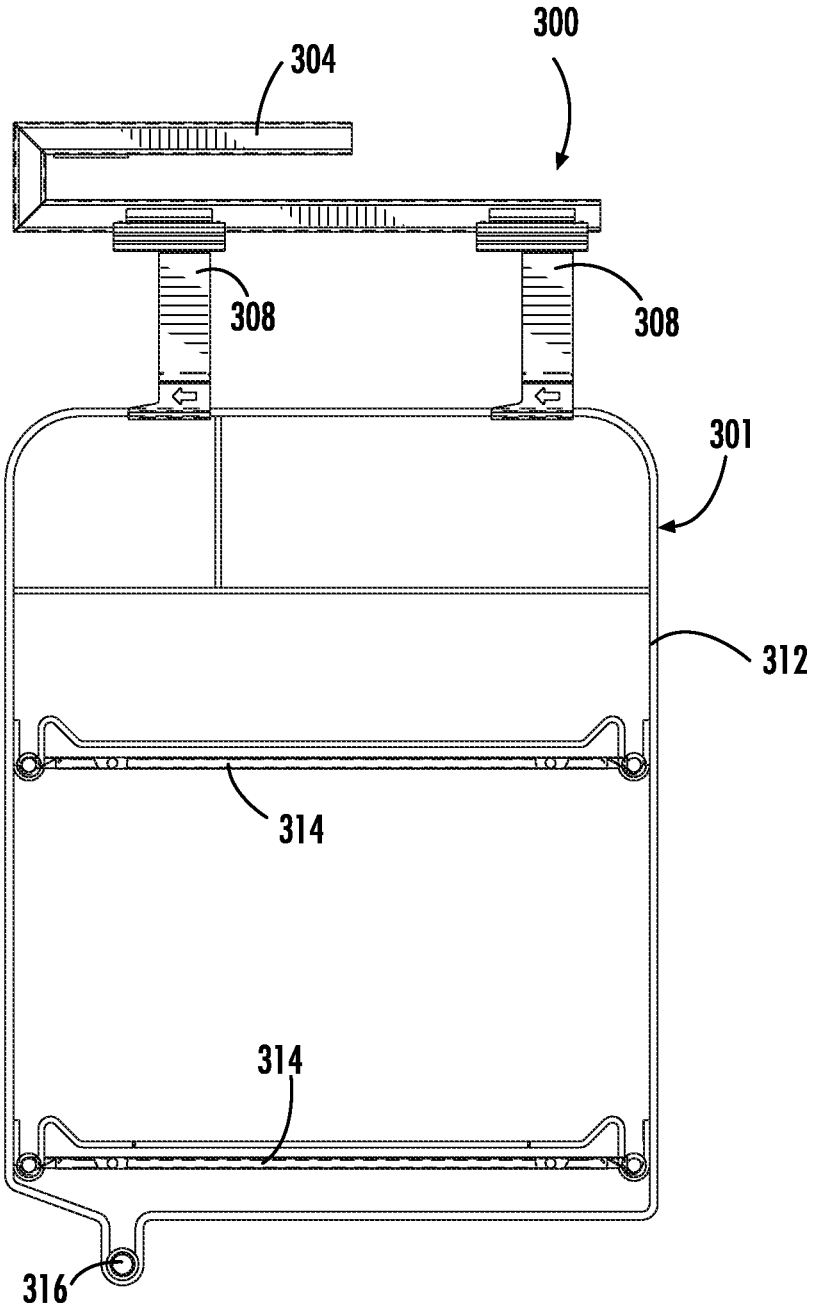
FIG. 48 is a right side elevation view of the shelving system shown in FIG. 46.

FIGS. 46-48 show another embodiment of a shelving system 300. The shelving system 300 may include left and right attachment brackets 302, 304 that are configured to be supported by a solid surface shelf 62 (not shown), such as wood, plastic, or composite, similarly to the attachment brackets 80 shown in FIG. 1, and hanging shelving 301. The hanging shelving 301 may include pairs of left and right rigid straps 306, 308 that depend from the attachment brackets 302, 304, left and right frames 310, 312 that depend from the rigid straps 306, 308, shelves 314 that are supported by the frames 310, 312, and a hang rod 316, also supported by the frames 310, 312.

Figure 49:
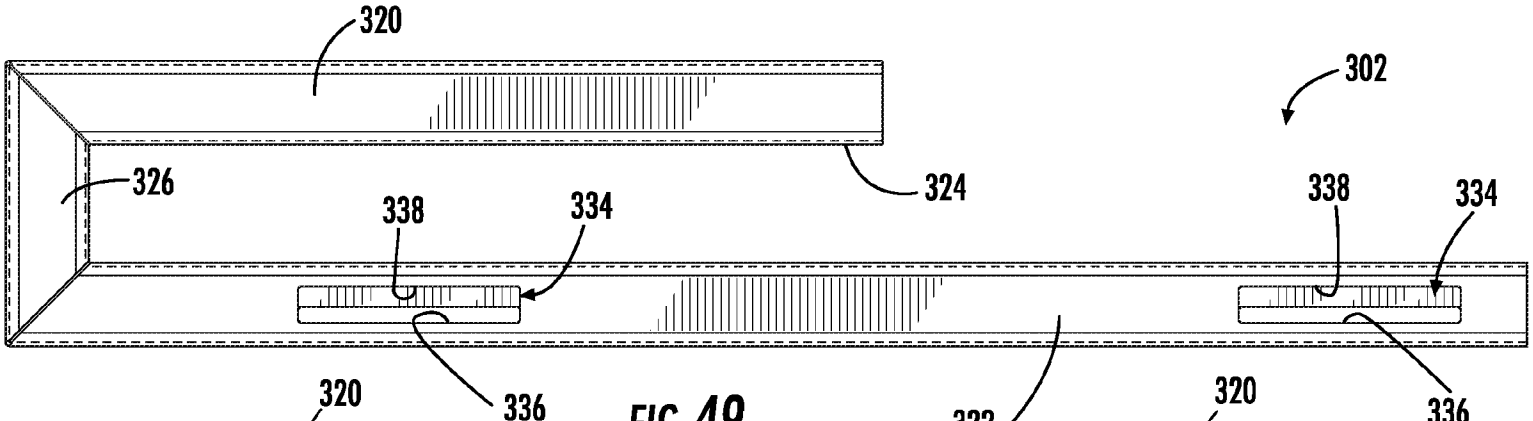
FIG. 49 is a right side elevation view of an embodiment of an attachment bracket of the shelving system shown in FIG. 46.
Figure 51:
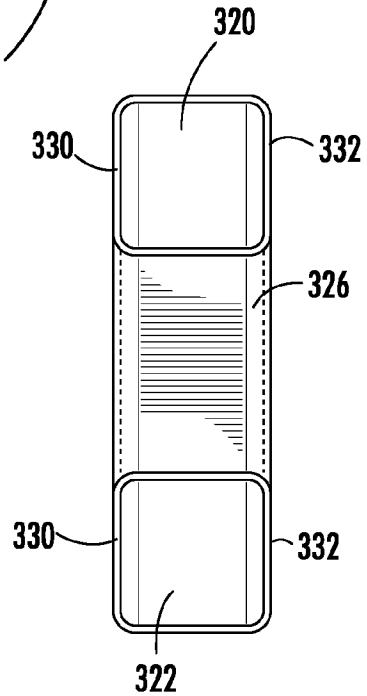
FIG. 51 is a front elevation view of the attachment bracket shown in FIG. 49.
Figure 50:
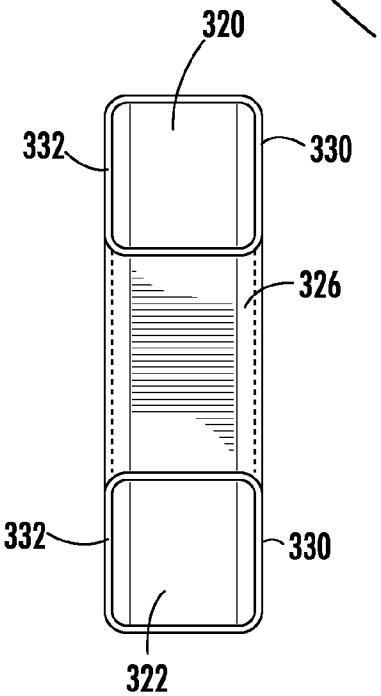
FIG. 50 is a rear elevation view of the attachment bracket shown in FIG. 49.
Figure 52:
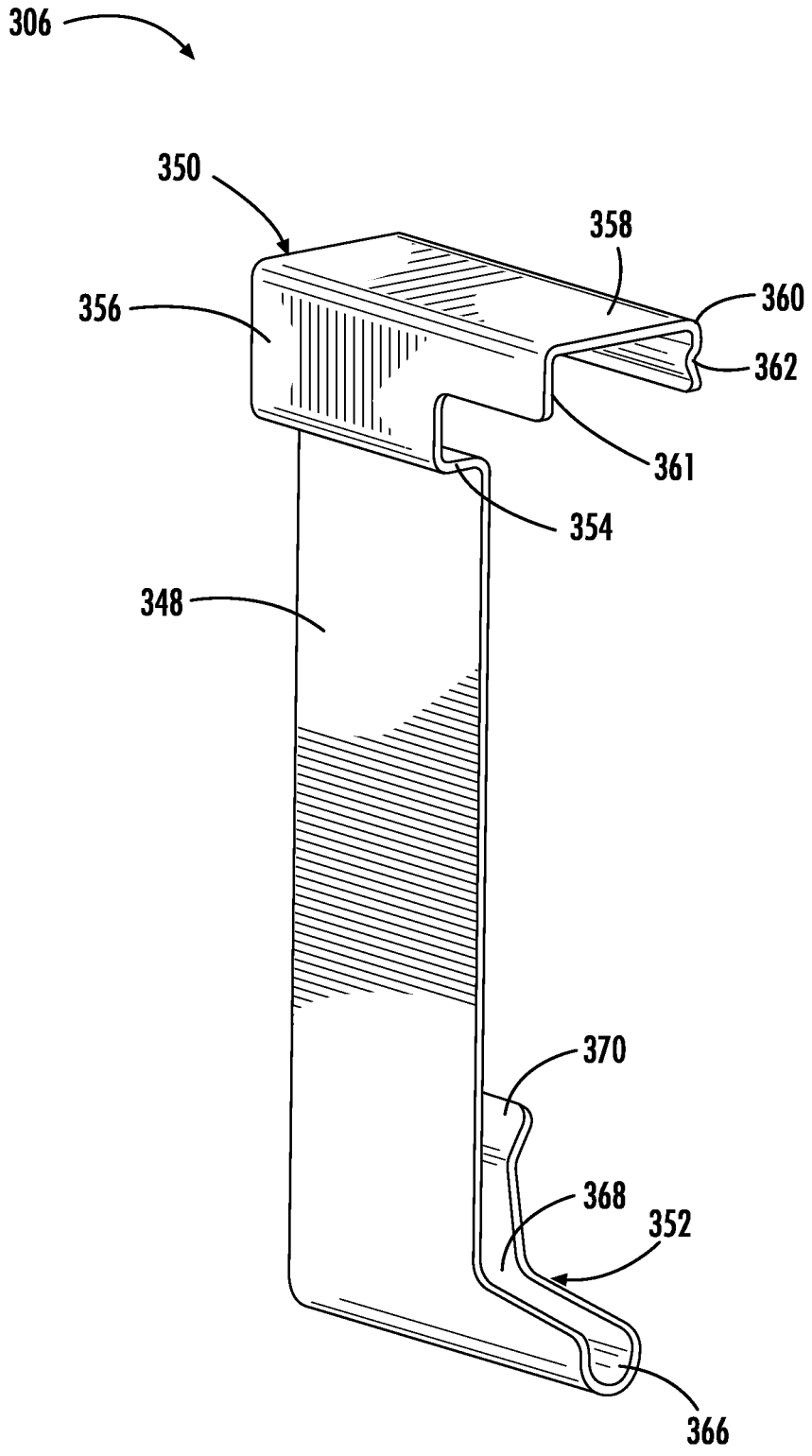
FIG. 52 is a perspective view of an embodiment of a rigid strap of the shelving system shown in FIG. 46.
Figure 55:
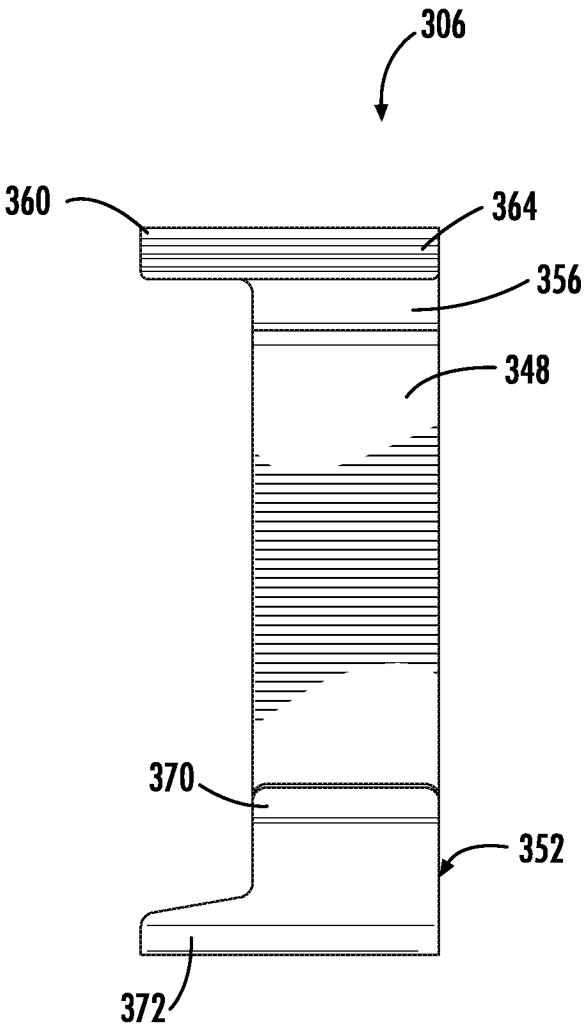
FIGS. 53, 54, and 55 are a front elevation view, a side elevation view, and a rear elevation view of the rigid strap shown in FIG. 52, respectively.
Figure 54:
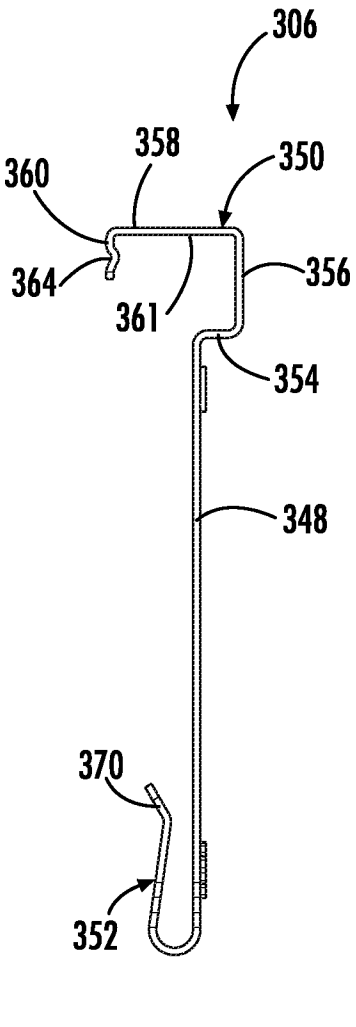
Figure 53:
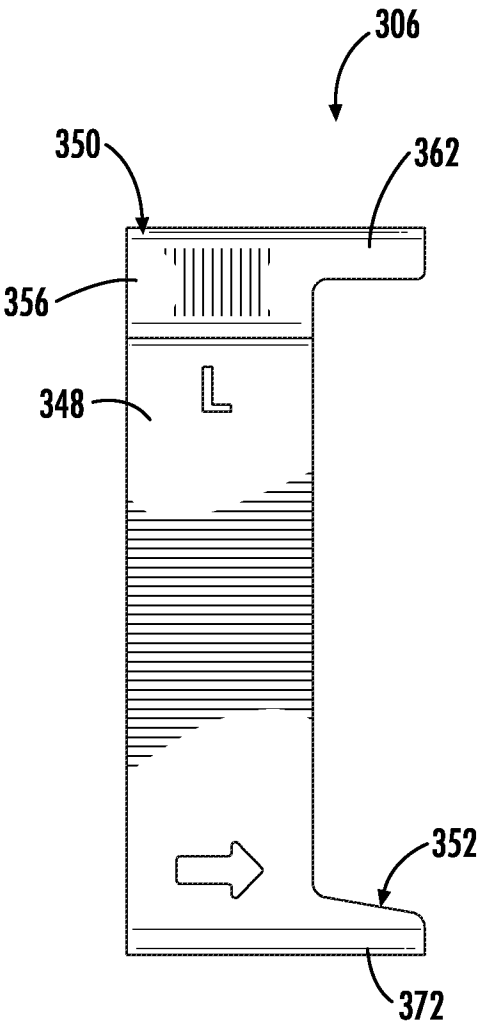

A left attachment bracket 302 is further detailed in FIGS. 49-51. The top leg 320 of the attachment bracket 302 may be substantially parallel to and opposes the bottom leg 322 to form an opening 324, and the front portion 326 connects the two legs 320, 322. This configuration permits sliding of the attachment bracket 302 around the shelf 62 (shelf 62, shelf deck 66, and front edge 68 of shelf 62 are as shown in FIG. 1) for mounting of the attachment bracket 302 on the shelf 62, with the top leg 320 resting on the shelf deck 66, the front portion 326 in contact with or proximate to the front edge 68 of the shelf 62, and the bottom leg 322 in contact with or proximate to the bottom of the deck 66. In this embodiment, the attachment bracket 302 is made of a rectangular tubular member having a left wall 330 and a right wall 332. There are two slots 334 through the bottom leg 322. The slots 334 may be at substantially the same position with respect to the height of the bottom leg 322. The slots 334 are defined by an elongated opening 336, 338 defined by each wall 330, 332. The left attachment bracket 302 that is shown, the openings 336, 338 have bottom edges that are at the same height, but the opening 336 in the left wall 330 is narrower than the opening 338 in the right wall 332. As will be discussed further below, this provides an appropriate fit to receive the rigid straps 306. The slots 334 may be spaced from front to back of the bottom leg 322, which spaces the rigid straps 306 to provide, with two attachment brackets 302, 304 with two slots 334 each, two points of support for each frame 310, 312. The top leg 320 and bottom leg 322 may be different lengths; in the embodiment shown the bottom leg 322 is longer than the top leg 320. The right attachment bracket 304 may be the same as the left attachment bracket 302, except the location of the narrow openings 336 and the wider openings 338 are reversed.

FIGS. 52-55 show an embodiment of a left rigid strap 306. The rigid straps 306, 308 may not be fully rigid, but are referred to as rigid because they are relatively rigid as compared to the straps 84 previously shown and described, which may be made of, for example, polyester, nylon, cotton webbing, or the like. Therefore, for the purposes of this disclosure, the term "rigid strap" may be considered to mean that the strap is substantially rigid, and that the rigidity of the rigid straps is sufficient to hold the weight that they support. A rigid strap 306 may include a flat, elongated central portion 348 with an upper hook 350 and a lower hook 352, where open ends of the upper hook 350 and the lower hook 352 oppose each other. Where a rigid strap 306, 308 is disclosed to apply pressure or provide a snap-fit, snug fit, or firm fit, it is understood that the strap has at least a slight resiliency that allows it to deflect even a small amount and apply a force to the part it engages.

The upper hook 350 in end view (FIG. 54) may circumscribe a portion of a rectangle, with a lower lateral portion 354 at a right angle to the elongated central portion 348, a left vertical portion 356 at a right angle to the lower lateral portion 354, an upper lateral portion 358 at a right angle to the left vertical portion 356, and a right vertical portion 360 extending downward at a right angle to the upper lateral portion 358 to form an opening 361 for receiving a portion of the lower leg 322 of the left attachment bracket 302. The upper hook 350 may have a portion 362 that extends forward of the elongated central portion 348. The right vertical portion 360 may have a crimp 364 along its length. The lower hook 352 may have a radius 366 and may be curved at the bottom and turns upward to form an opening 368 for receiving the top of the frame 310, with the hook 352 flared outward 370 at the top. The lower hook 352 also may have a portion 372 that extends forward of the elongated central portion 348. Both portions 364, 372 that extend forward of the elongated central portion 348 help to resist front to back torsion from the frame 310.

Figure 56:
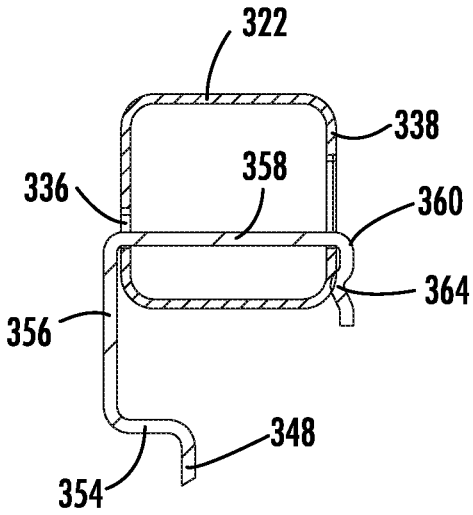
FIG. 56 is a connection detail of the attachment bracket of FIG. 49 and the rigid strap shown in FIG. 52.

FIG. 56 shows the upper hook 350 inserted into the lower leg 322 of the left attachment bracket 302. To assemble these parts, the right vertical portion 360 may first be inserted into the opening 336 through the left wall 330 of the lower leg 322. Then the upper hook 350 is rotated to allow the upper lateral portion 358 to pass through that opening 336, and the opening 338 through the right wall 332 is large enough to allow the right vertical portion 360 to pass through. The attachment bracket 302 is then rotated such that the crimp 364 applies pressure to the lower right corner of the upper hook 350 to releaseably secure the upper hook 350 in position. Each of the right attachment brackets 304, the right rigid straps 308, and the attachment of the right rigid straps 308 to the right attachment brackets 304 are mirror images of the views of the left attachment bracket 302, the left rigid straps 306, and the attachment of the left rigid straps 306 to the left attachment brackets 302, respectively, shown in FIGS. 49-56.

Figure 57:
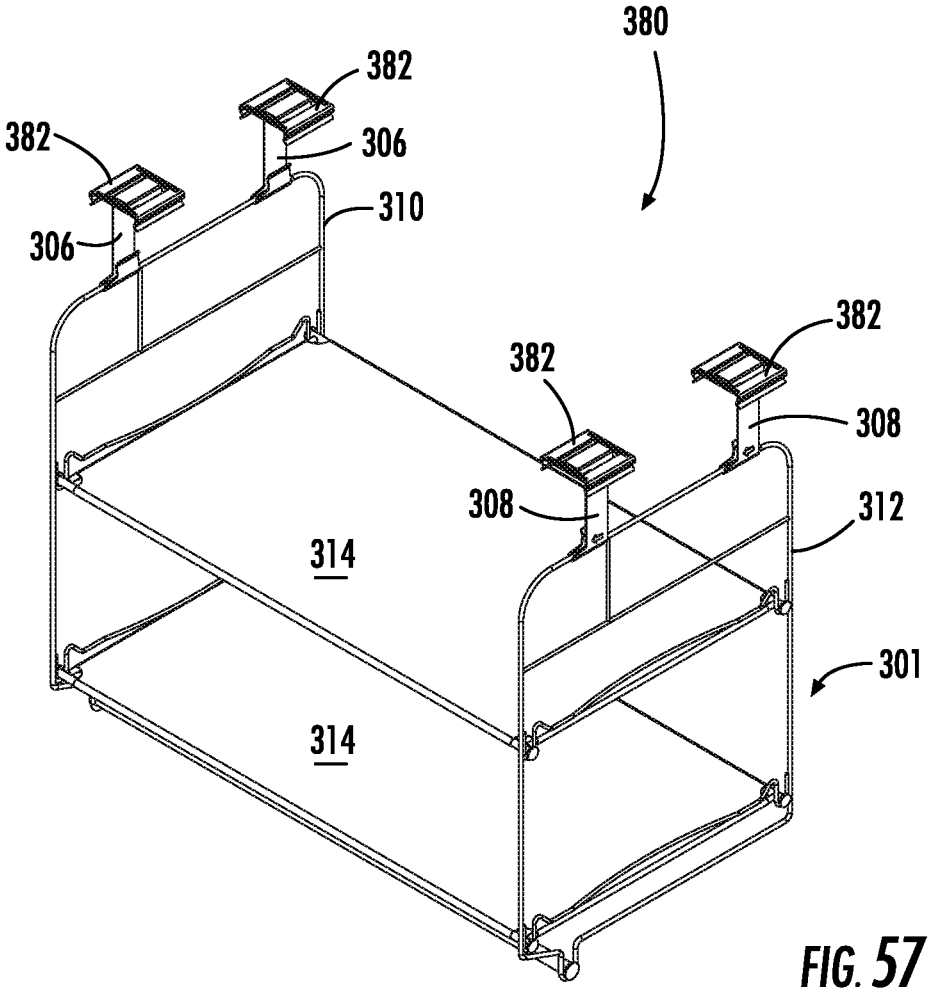
FIG. 57 is a perspective view from above of another embodiment of a shelving system including attachment brackets for a wire support shelf.
Figure 58:
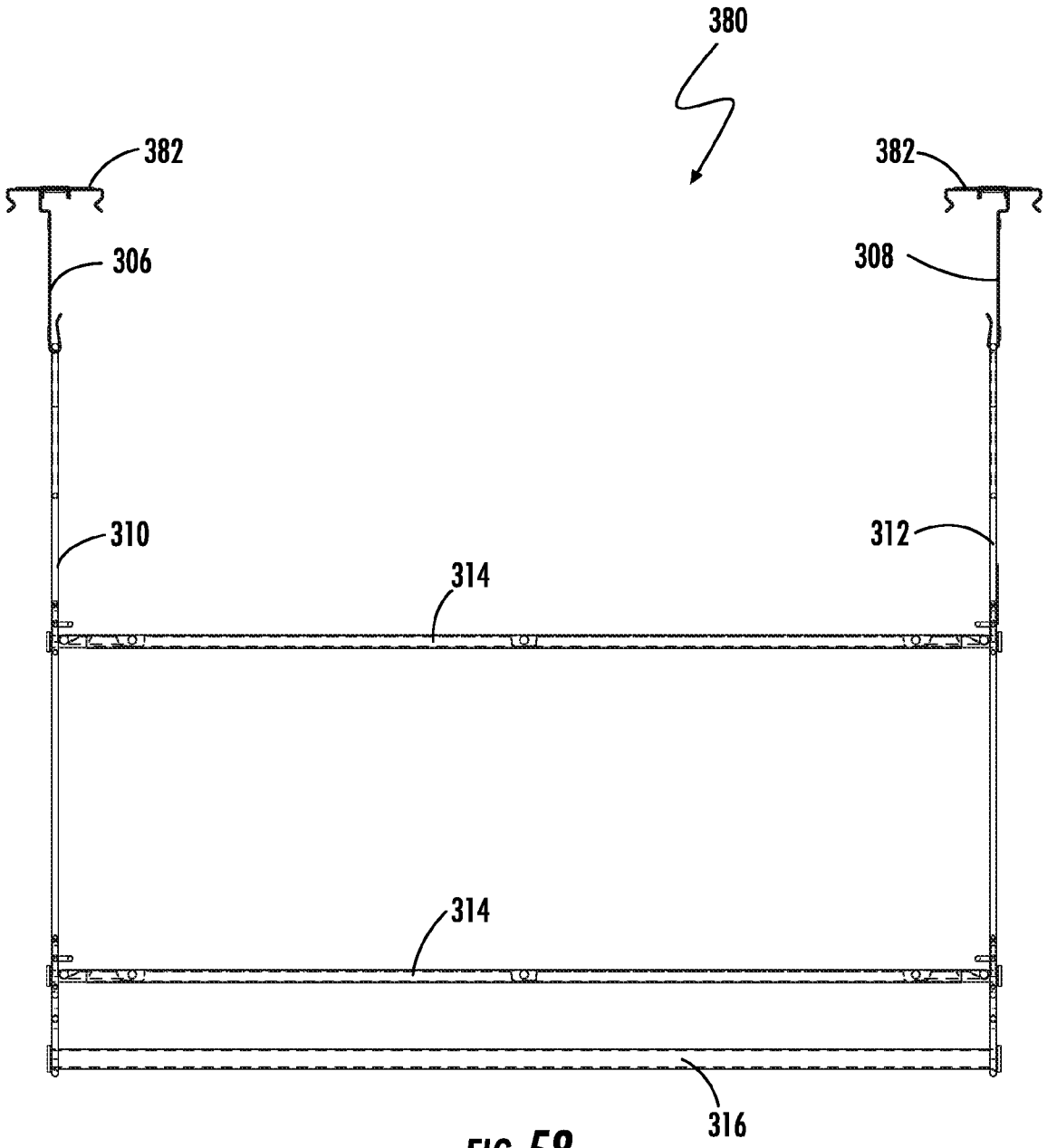
FIG. 58 is a front elevation view of the shelving system shown in FIG. 57.
Figure 59:
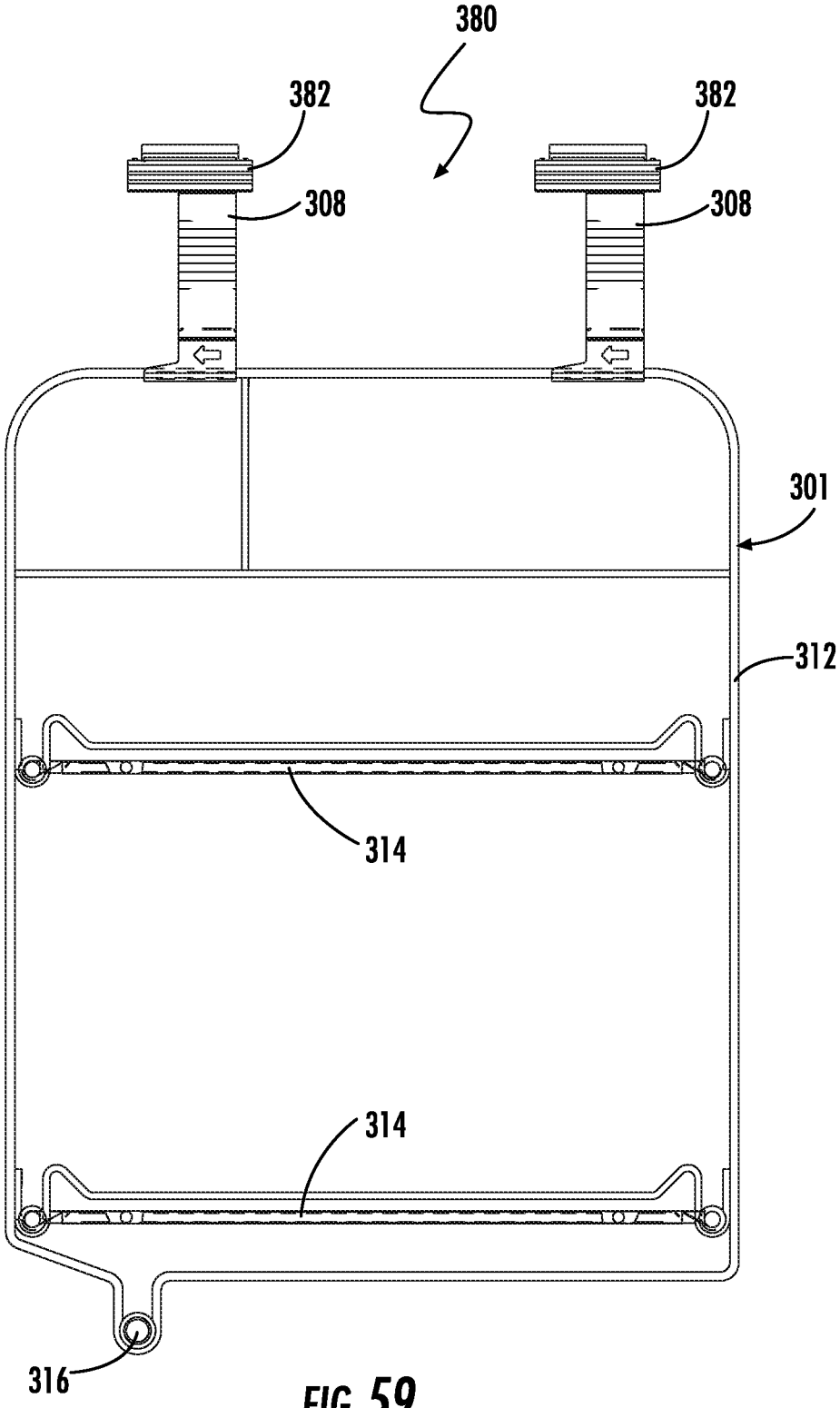
FIG. 59 is a right side elevation view of the shelving system shown in FIG. 57.
Figure 60:
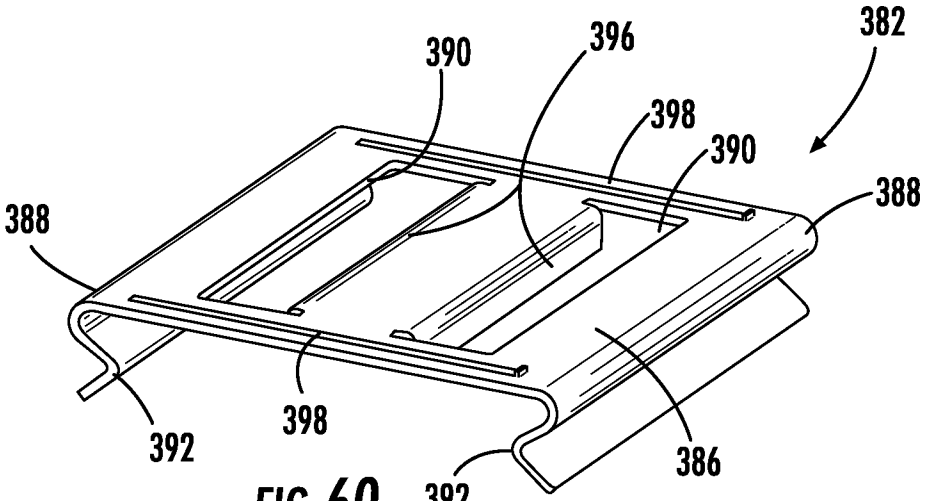
FIG. 60 is a top perspective view of an embodiment of an attachment bracket of the shelving system shown in FIG. 57.
Figure 61:
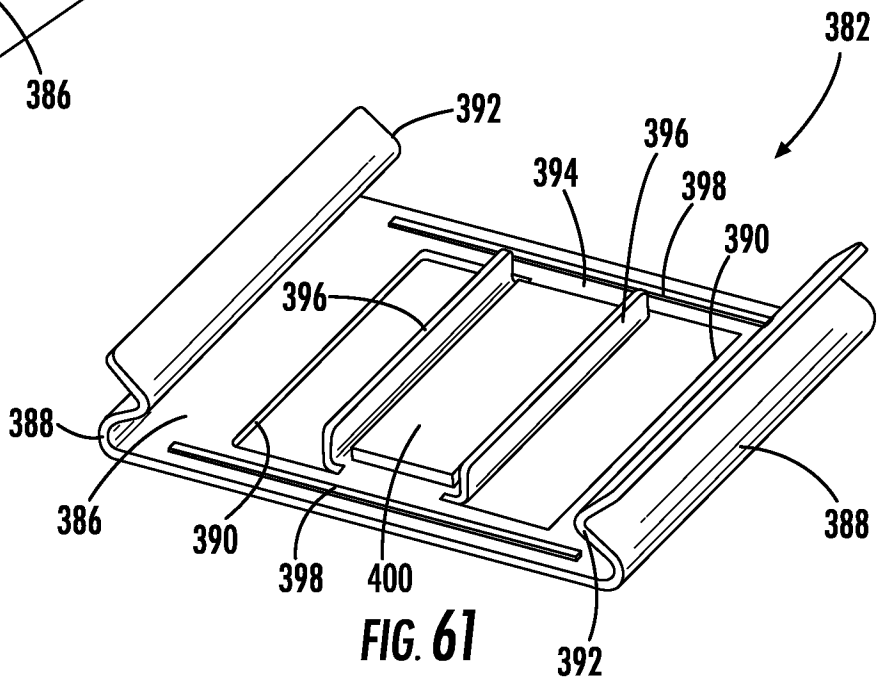
FIG. 61 is a bottom perspective view of the attachment bracket shown in FIG. 60.
Figure 62:
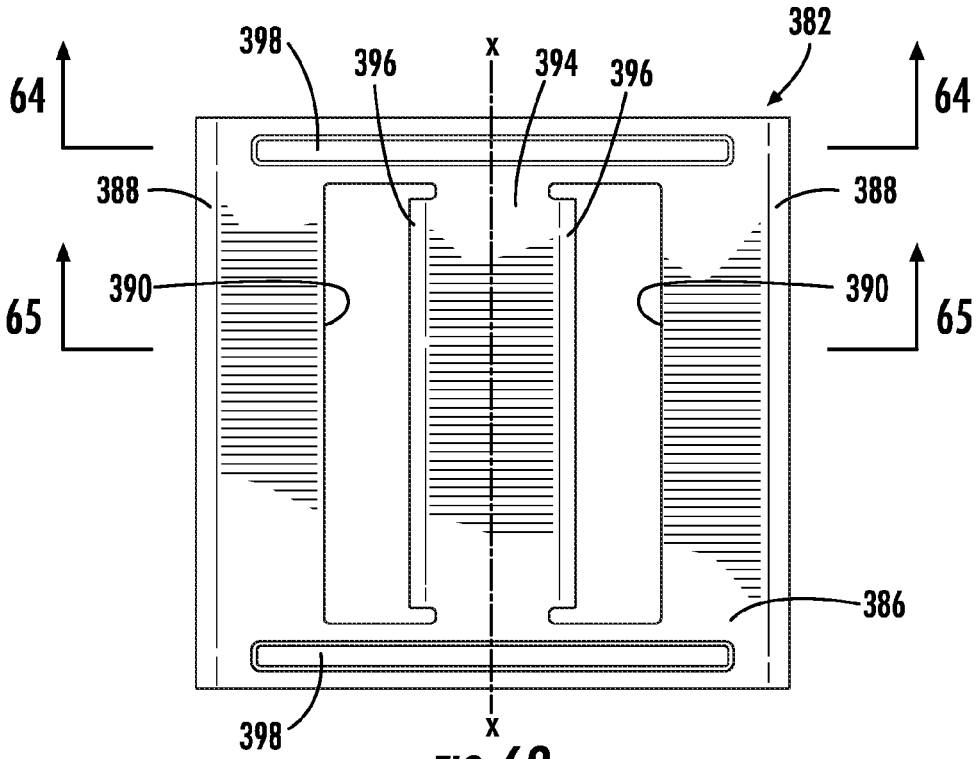
FIG. 62 is a top plan view of an embodiment of the attachment bracket shown in FIG. 60.
Figure 63:
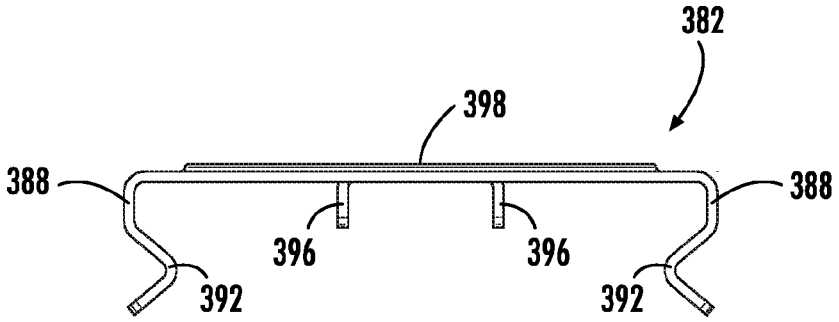
FIG. 63 is a front elevation view of the attachment bracket shown in FIG. 60
Figure 64:
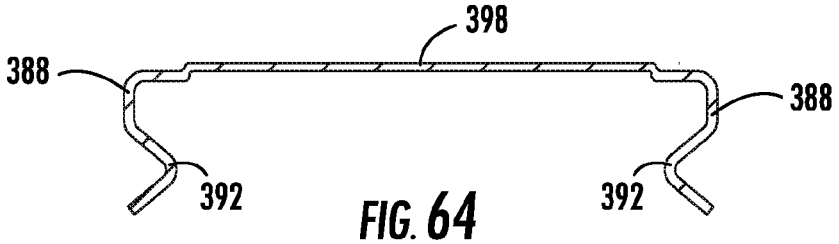
FIG. 64 is a cross-section view of the attachment bracket shown in FIG. 60 taken along line 64-64 of FIG. 60.
Figure 65:
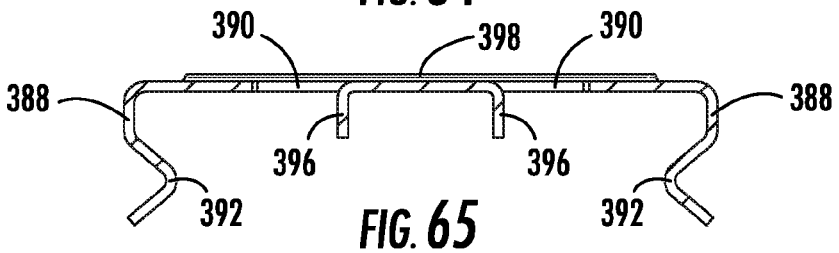
FIG. 65 is a cross-section view of the attachment bracket shown in FIG. 60 taken along line 65-65 of FIG. 60.

FIGS. 57-59 show another shelving system 380 in which the hanging shelving 301 is incorporated. Instead of the left and right attachment brackets 302, 304 that are configured to be supported by a solid surface shelf 62, a second embodiment of four attachment brackets 382 are configured to be supported by a wire shelf 142 (not shown). The four wire shelf attachment brackets 382 are positioned on the deck 144 (not shown) in a substantially rectangular configuration similarly to the previously described wire shelf attachment bracket 150 embodiment, and hanging shelves 301 are suspended from the attachment brackets 382 with rigid straps 306, 308. The four attachment brackets 382 provide four points of support for the hanging shelves 301 for stability and strength. FIGS. 57-59 show the modularity of the hanging shelving 301 between a solid surface shelf application and a wire shelf application, as solid surface shelving attachment brackets 302, 304 and wire shelving attachment brackets 382 may be used interchangeably with the hanging shelving 301.

FIGS. 61-65 show this embodiment of a wire shelf attachment bracket 382 in detail. The bracket 382 may include a rectangular, substantially planar top portion or plate referred to as a body 386 and other features that are configured substantially symmetrically about the longitudinal axis X-X of the bracket 382. Such features may include curved downturned edges 388 and elongated substantially parallel openings or slots 390, with both the downturned edges 388 and the slots 390 oriented parallel to the longitudinal axis. The edges 388 may include returns 392, in which the downturned edges 388 curve toward the longitudinal axis X-X and then outward. The slots 390 are on either side of a center portion 394 of the body 386 and each has on its side proximate to the center of the body 386 downwardly curved lips 396. Two ridges 398 transverse to the longitudinal axis X-X are provided adjacent to the transverse edges for strength.

Figure 66:
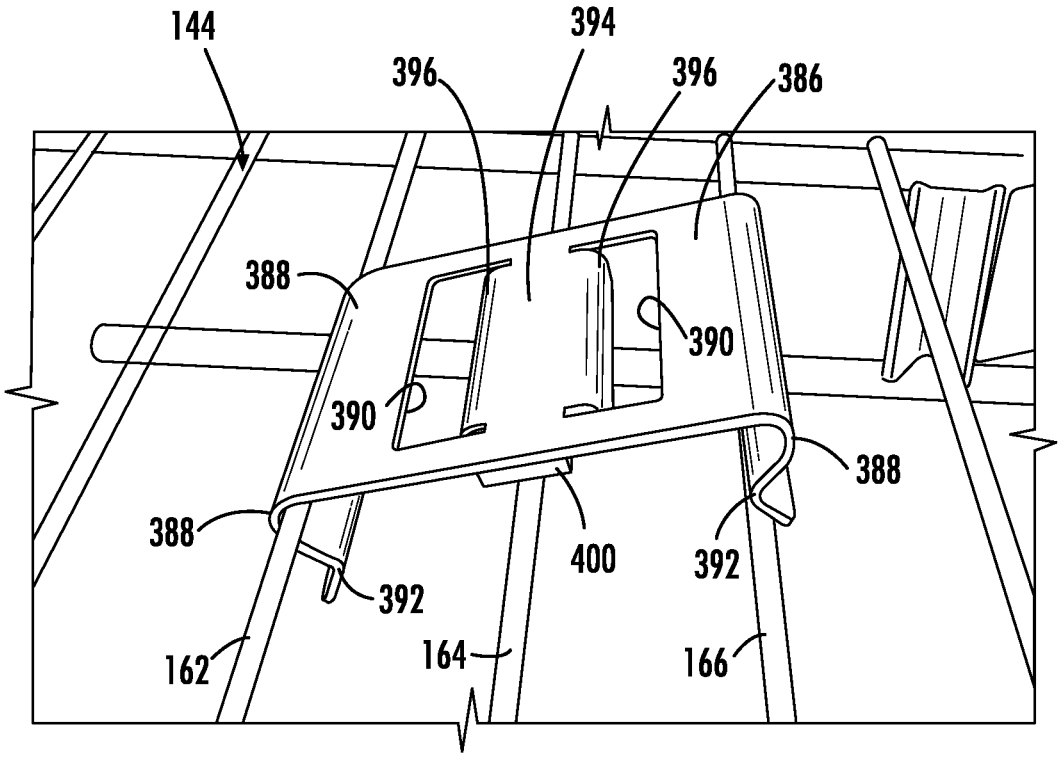
FIG. 66 is a perspective view of the installation of the attachment bracket of FIG. 60.
Figure 67:
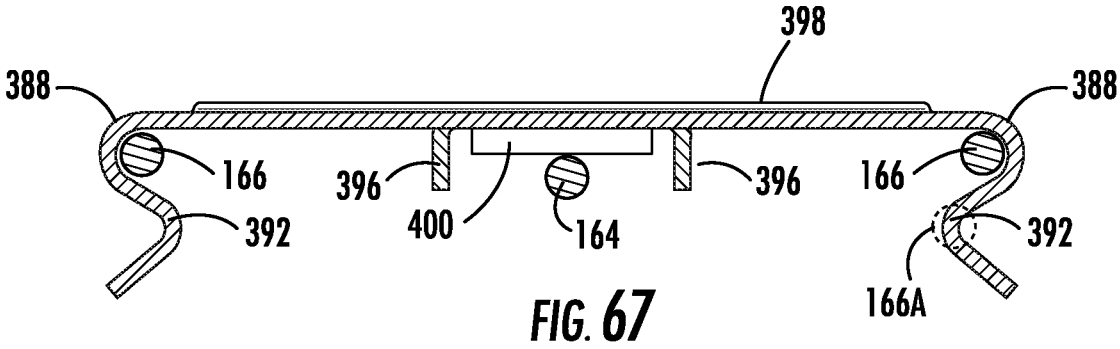
FIG. 67 is a lateral center cross-section of the installed attachment bracket of FIG. 66.
Figure 68:
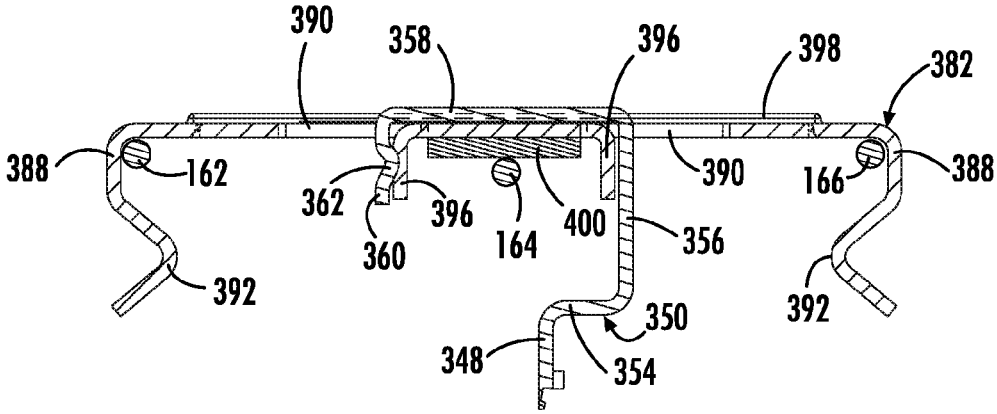
FIG. 68 is a lateral cross-section detail of the attachment bracket of FIG. 60 with the rigid strap of FIG. 52 installed.

FIGS. 66-68 show the installation of a wire attachment bracket 382 and an associated rigid strap 308. First, in FIG. 66 (ridges 398 not shown) the attachment bracket 382 is tilted to allow insertion of one edge 388 through the wires 162, 164. As shown, in this embodiment an adhesive-backed resilient pad 400 is added on the bottom surface of the center portion 394 of the body 386. The pad 400 may be, for example, a resilient material such as rubber or other elastomeric material. The attachment bracket 382 is positioned with the return 392 such that the left wire 162 is caught in the inside radius of the left downturned edge 388. Next, in FIG. 67 the attachment bracket 382 is rotated downward to place the right downturned edge 388 in contact with the right wire 166*a*, requiring the wire 166 to deflect and depressing the wire into position 166*a*. The wire 166 will then flex to snap into the final position shown in the inside radius of the right downturned edge 388. Concurrently, the pad 400 is placed in contact with the middle wire 164, and depresses that wire 164 downward such that that wire 164 in the final position exerts a force upward on the attachment bracket 382. As a result, the attachment bracket 382 is secured in a firm relationship with the shelf 144.

FIG. 68 shows the installed attachment bracket 382 with a right rigid strap 308 inserted through it. To install the right rigid strap 308, the rigid strap 308 is tilted, and the left vertical portion 360 of the upper hook 350 is inserted into the right slot 390. The upper lateral portion 358 is inserted through the right slot 390 as the strap 308 is rotated counterclockwise until the left vertical portion 360 is in position over the left lip 396 of the attachment bracket 382 and the upper lateral portion 358 is positioned over the central portion 394 of the attachment bracket 382. The crimp 362 applies pressure to the left lip 396 to secure the rigid strap 308 in a firm relationship with the attachment bracket 382.

This embodiment of the attachment bracket 382 shown spans three wires 162, 164, 166 of the wire shelf deck 144, where preferably the attachment bracket 150 is centered on the center wire 164 such that the pad 400 applies pressure to the center wire 164. The distance between the curved edges 388 is preferably set such that the curved edges 388 engage the outside wires 162, 166 and prevent lateral movement of the attachment bracket 150. The attachment bracket 382 could have an offset structure such that the rigid strap 308 is not aligned with the center wire 164. Spanning a plurality of wires increases the stability and strength of the deck support of the rigid straps 306, 308. The fastener is releasable to allow relocation or adjustment of the position of the attachment brackets 382 and system 380.

The material of the attachment brackets 302, 304, 382 and rigid straps 306, 308 may generally be expected to be metal, such as a low carbon steel or other steel alloy, or alternatively may be a plastic, and may be high strength polymer and/or include carbon reinforcing, but may be other metals or materials as selected by one of ordinary skill in the art. Methods of manufacture may include, but not be limited to, injection molding, die casting, sand casting, or extrusion. If metal, a surface treatment may be applied for corrosion protection, for example, a zinc coating by a barrel plating process, galvanizing, or a powder based epoxy or paint coating, or as otherwise selected by one of ordinary skill in the art.

Figure 69:
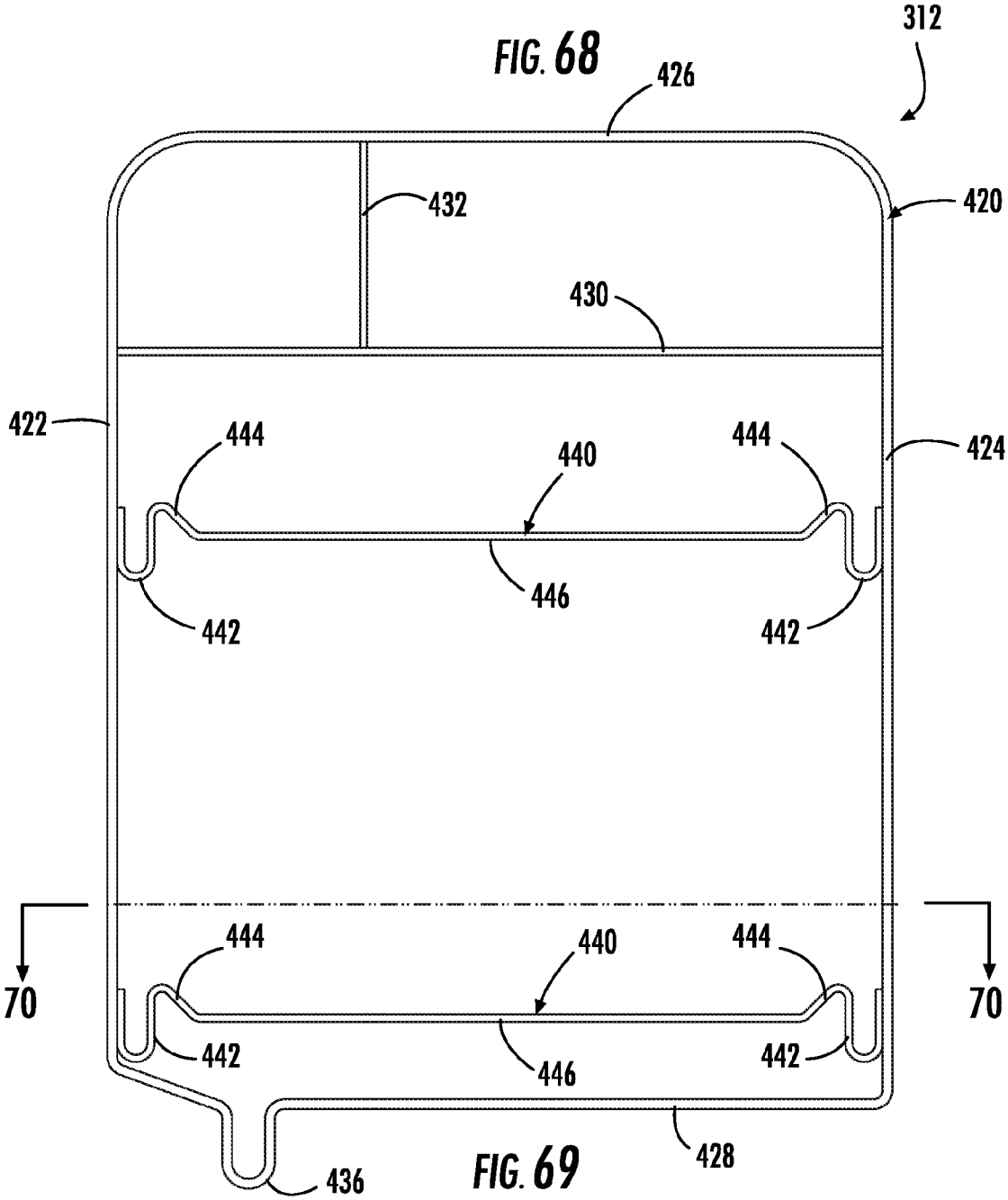
FIG. 69 is a right side elevation view of an embodiment of a frame of the shelving systems shown in FIGS. 46 and 57.
Figure 70:
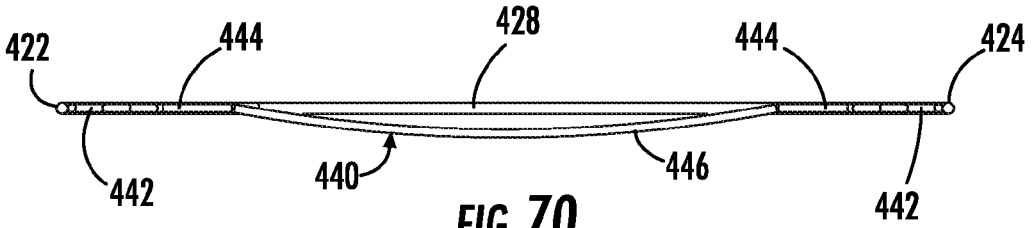
FIG. 70 is a section view of the frame shown in FIG. 69 taken along line 70-70 of FIG. 69.
Figure 71:
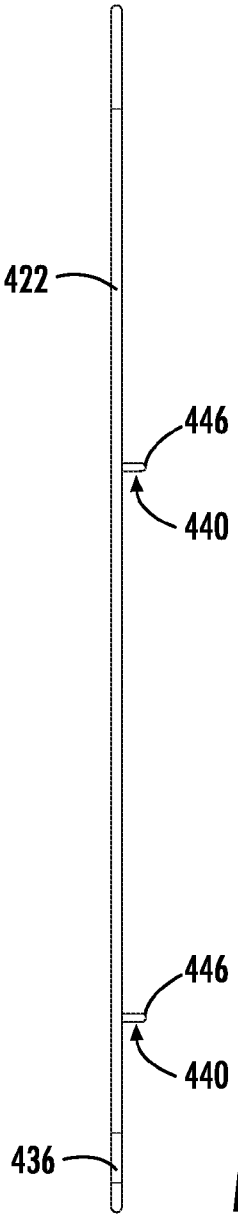
FIG. 71 is a front elevation view of the frame shown in FIG. 69.

Left and right frames 310, 312 are provided that are a mirror view of each other, with the left frame 312 shown in FIGS. 69-71. The frames 310, 312 are made, in this embodiment, entirely of relatively thin rod that may be referred to as wire. The left frame 312 may include a perimeter member 420 that may have sections designated as a first or front stanchion 422, a second or rear stanchion 424, a top transverse member 426, and a bottom transverse member 428, which are substantially at right angles to each other around the perimeter member 420. Proximate to the top transverse member 426 is a structural transverse member 430 connected to each stanchion 422, 424, and connecting to and extending upward from the structural transverse member 430 is a structural vertical member 432 that is connected to the top transverse member 426. The structural transverse member 430 and the structural vertical member 432 may be in any variety of configurations that provide overall structural support to the frame 312.

The bottom transverse member 428 defines a U-shape proximate to but spaced from the front stanchion 422, with the open end of the "U" facing upward to form a hanging rod receiving element 436. The wire in the area between the hanging rod receiving element 436 and the front stanchion 422 is moderately sloped downward from the front stanchion 422 to the hanging rod receiving element 436 to provide a bend that is less severe than a right angle, and may be an aesthetic and functional improvement over a right angle.

The frames 310, 312 may include two shelf supporting elements 440; more or less could be provided. The shelf supporting elements 440 may be transverse members connected and substantially perpendicular to the front stanchion 422 and the rear stanchion 424. Connections may be made by, for example, welding. Adjacent to the front stanchion 422 and the rear stanchion 424, each shelf supporting element 440 defines a substantial U-shape, although other shapes that provide the needed functionality may be used, with the open end of the "U" facing upward to form a shelf rod receiving element 442. Inward from and adjacent to the shelf rod receiving element 442 the shelf supporting element 440 is bent upward and then downward to form a substantial V-shape, although other shapes that provide the needed functionality may be used, with the open end of the "V" facing downward to form a biasing means 444. In between the biasing means 444, the shelf supporting element 440 forms an arc shape that may be designated as a shelf retaining portion 446.

Figure 72:
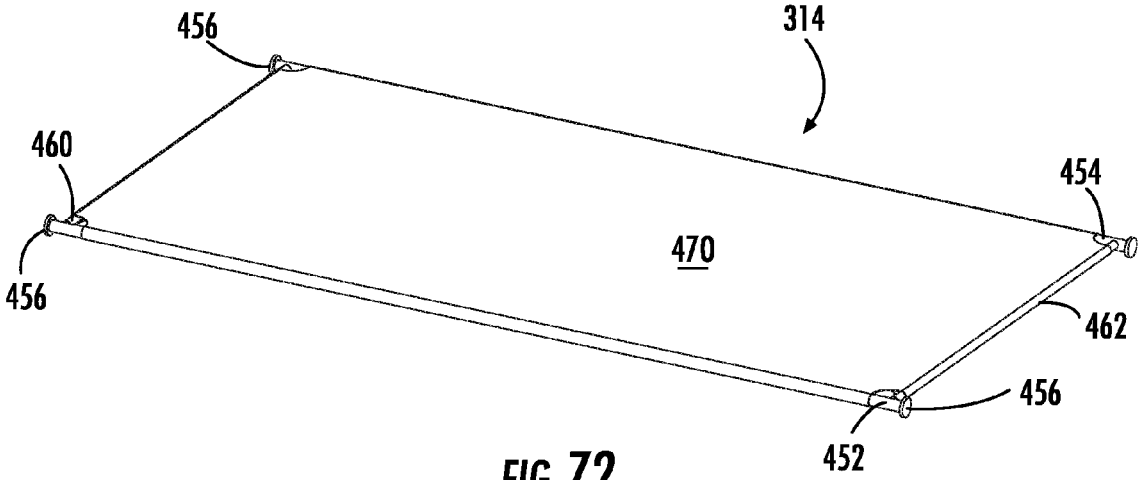
FIGS. 72 and 73 are top and bottom perspective views, respectively, of an embodiment of the shelf shown in FIGS. 46 and 57.
Figure 73:
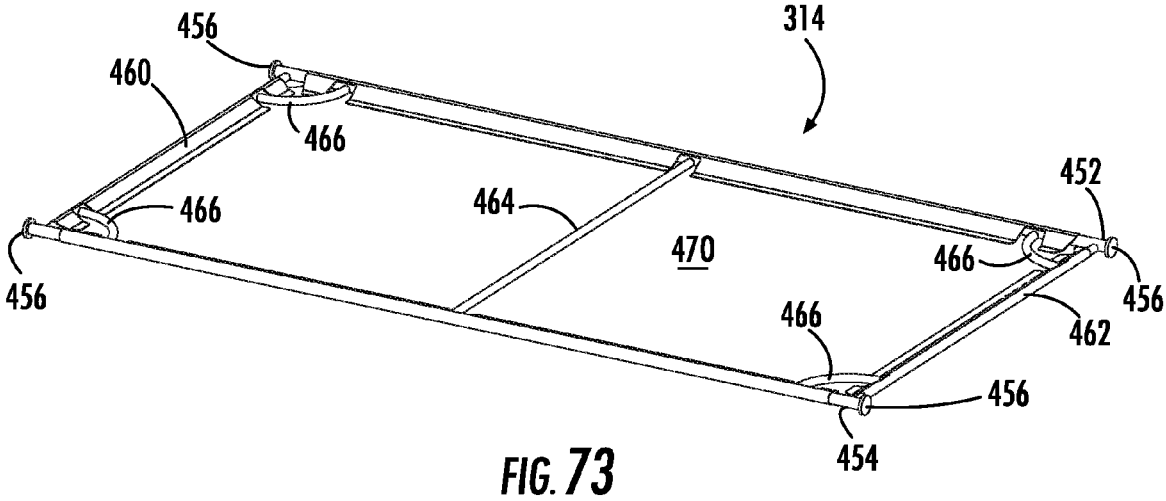

Top and bottom views of a shelf 314 are shown in FIGS. 72 and 73, respectively. The shelf 450 is substantially rectangular. At the front of the shelf 314 is a front shelf rod 452 and at the rear of the shelf is a rear shelf rod 454. The rods 452, 454 may include knobs 456 at the left and right ends. There are three transverse members 460, 462, 464, two of which 460, 462 define the left and right sides of the shelf 450, with the third member 464 providing structural stability and support at the midpoint of the shelf 314. At each corner is a curved member 466 that connects the rods 452, 454 to adjacent side members 460, 462 and provides structural stability. A thin film 470 is wrapped around the rods 452, 454 and side members 460, 462 and secured to itself. The film may be a plastic, such as polyethylene, in which case the film may be secured to itself with a weld, or the film could be other materials, such as a fabric, for example, canvas or polyester, in which case the film could be sewn to itself.

Figure 74:
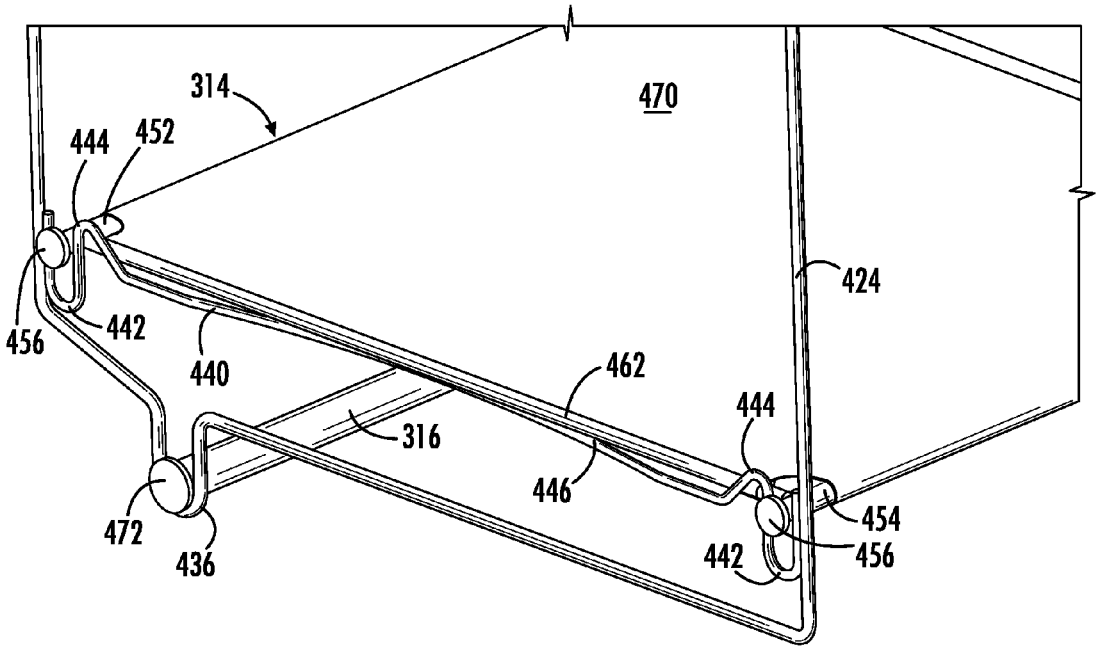
FIGS. 74 and 75 are detailed perspective views of the frame shown in FIG. 69 and the shelf shown in FIGS. 72 and 73.
Figure 75:
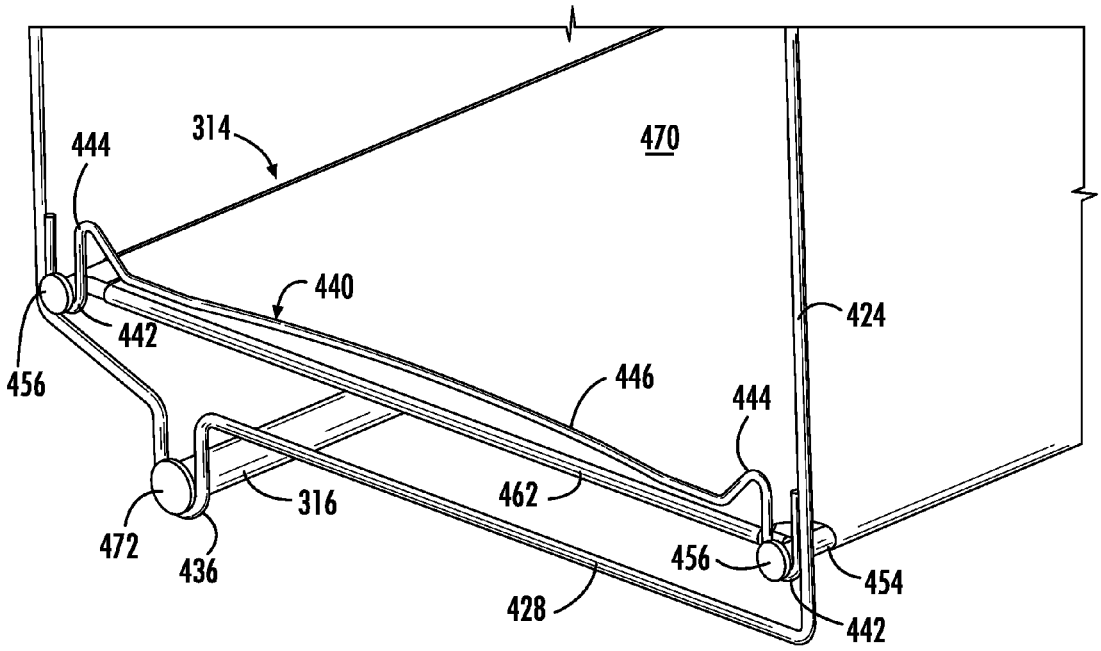

FIGS. 74 and 75 show the installation of a shelf 314 in the right frame 312. In FIG. 74, the shelf 314 is placed such that the front shelf rod 452 and the rear shelf rod 454 are in the opening to the shelf rod receiving element 442. Concurrently, the shelf 314 and the side member 462 are resting on the shelf supporting element 440, and in particular on the shelf retaining portion 446, which protrudes inward toward the center of the shelf 314. In FIG. 75, the shelf 314 is pushed downward, and the shelf retaining portion 446 deflected out of the way, or may be directly retracted out of the way by an installer, and the front shelf rod 452 and the rear shelf rod 454 are seated in their respective shelf rod receiving elements 442, which supports the shelf rods 452, 454 and, in turn, the shelf 314, in the assembled position. When the shelf 314 is in the assembled position, the shelf retaining portion 446 may block upward movement of the shelf 314 and may apply downward pressure to secure the shelf 314 to the frame 312, and to establish a firm relationship between shelf 314 and the frame 312. Such pressure may be generated by the biasing means 444, which may have a spring-like characteristic. The biasing means 444 may also bear against the side of the shelf 314 to prevent lateral movement of the shelf 314. Knobs 456 on the end of each shelf rod 452, 454 and knobs 472 on the end of the hanging rod 316 retain the rods 316, 452, 454 in the frames 310, 312, and prevent the frames 310, 312 from moving off of the rods 316, 452, 454.

The material of the frames 310, 312, rods 316, 452, 454, and other members of the shelves may include, but not be limited to, for example, steel with an epoxy coating, and in one example may be 3 or 4 mm diameter. Alternatively, such parts could be plastic.

The embodiments of shelving systems 300, 380 disclosed in FIGS. 46-75 provide modular systems that may be used with solid surface shelving and wire shelving. The systems 300, 380 may be assembled and disassembled relatively easily, without the use of tools or fasteners, and may be relatively light weight. The frames 310, 312 and shelves 314 may fit together to provide a firm fit that is structurally stable. The components may be made to assemble with a snap-fit type configuration.

Although the present invention has been shown and described in considerable detail with respect to only a few exemplary embodiments thereof, it should be understood by those skilled in the art that there is no intent to limit the invention to the embodiments since various modifications, omissions, and additions may be made to the disclosed embodiments without materially departing from the novel teachings and advantages of the invention, particularly in light of the foregoing teachings. For example, some of the novel features of the shelving system and components could be applied to other types of sup ort apparatus, whether related to shelving or otherwise. Accordingly, it is intended to cover all such modifications, omission, additions, and equivalents as may be included within the spirit and scope of the invention as defined by the following claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A shelving system, comprising:

two frames comprising wire, the frames for forming ends of the shelving system, each frame including a first stanchion, a second stanchion, and a wire shelf support element extending between the first stanchion and the second stanchion, the shelf supporting element including a first shelf rod receiving element and a second shelf rod receiving element, wherein the shelf rod receiving elements are integral to the shelf support elements; and a shelf including a first rod and a second rod spaced from the first rod, wherein the first shelf rod receiving elements are configured to receive and support the first rod, and the second shelf rod receiving elements are configured to receive and support the second rod, and wherein the shelf rod receiving elements each include spring-like biasing means for retaining the shelf in an assembled position with the first rod received in the first shelf rod receiving element and the second rod received in the second shelf rod receiving element.

2. The shelving system of claim 1, wherein the shelf rod receiving elements define a U-shaped opening for receiving the rods.

3. A shelving system, comprising:

two frames comprising wire, the frames for forming ends of the shelving system, each frame including a first stanchion, a second stanchion, and a wire shelf support element extending between the first stanchion and the second stanchion, the shelf supporting element including a first shelf rod receiving element and a second shelf rod receiving element, wherein the shelf rod receiving elements are integral to the shelf support elements; and a shelf including a first rod and a second rod spaced from the first rod, wherein the first shelf rod receiving elements are configured to receive and support the first rod, and the second shelf rod receiving elements are configured to receive and support the second rod, wherein the shelf rod receiving elements each include biasing means for retaining the shelf in an assembled position with the first rod received in the first shelf rod receiving element and the second rod received in the second shelf rod receiving element, and wherein the shelf supporting element, including the first shelf rod receiving element, the second shelf rod receiving element, the biasing means, and a shelf retaining portion are together formed from one piece of continuous wire.

4. The shelving system of claim 1, wherein the two frames are spaced for receiving the shelf, each shelf supporting element includes a shelf retaining portion, and in a first position the shelf rests on the shelf retaining portion, contacting the shelf retaining portion on a first side of the shelf, and in a second, assembled position the shelf rods are seated in the shelf rod receiving elements and the shelf retaining portion contacts the shelf on an opposite, second side of the shelf.

5. The shelving system of claim 4, wherein the wire shelf supporting element includes integral biasing means comprising bent wire at each end of the shelf retaining portion, wherein the spring-like biasing means urges the shelf retaining means to apply force to the second side of the shelf.

6. The shelving system of claim 5, wherein the biasing means are adjacent to the shelf rod receiving means, the biasing means defines an opening with an open end facing a first direction, and the shelf rod receiving means each define an opening with an open end facing in a substantially opposite second direction.

7. A shelving system, comprising:

two frames comprising wire, the frames for forming ends of the shelving system, each frame including a shelf supporting element including a first shelf rod receiving element and a second shelf rod receiving element;

a plurality of attachment brackets configured to be supported by a fixed position shelf and each defining at least one slot, and a rigid strap mounted to each bracket, the rigid strap including a first end and a second end with a hook portion at each end, the hook at the first end for engaging the associated bracket at one of the at least one slots and the hook at the second end for engaging one of the frames by receiving the wire of the frame in that hook; and a shelf including a first rod and a second rod spaced from the first rod, wherein the first shelf rod receiving elements are configured to receive and support the first rod, and the second shelf rod receiving elements are configured to receive and support the second rod.

8. The shelving system of claim 7, wherein each bracket comprises tubing including a wall and is configured to be mounted to a solid surface shelf, each bracket further comprising:

an elongated first leg with a proximal end and a distal free end;

an elongated second leg with a proximal end and a distal free end, and a connecting portion, wherein the proximal end of the first leg is connected to the connecting portion, the proximal end of the second leg is connected to the connecting portion, and the first leg and second leg are substantially parallel and extend from the connecting portion in substantially the same direction to define an elongated opening, wherein the opening between the legs is adapted to receive the front edge and a portion of the deck of the shelf.

9. The shelving system of claim 8, wherein each bracket defines a slot formed by openings through opposite sides of the tubing, wherein the opening in one side of the tubing is narrower than the opening through the opposite side of the tubing.

10. The shelving system of claim 9, wherein the slot in each bracket is configured to receive the hook at the first end of the rigid strap through the openings in the tubing.

11. The shelving system of claim 10, wherein the hook at the first end of the rigid strap includes a crimp that applies pressure to the tubing.

12. The shelving system of claim 7, wherein each bracket is configured to be mounted to a wire shelf deck across a plurality of wires, each bracket comprising a plate having a body and first edge parallel to and spaced from a second edge, wherein the first and second edges are bent in the same direction relative to the body, the body defining first and second substantially parallel slots adapted to receive a strap, wherein the slots are substantially parallel to the first and second edges.

13. The shelving system of claim 12, wherein the first and second edges are bent to be substantially arcuate, forming an inside surface on the inner radius of each arcuate edge, and are further bent to include a return, wherein the first and second edges and the returns are each spaced to receive spaced wires of the wire shelf deck, and wherein assembly of the bracket to the wire shelf deck requires deflection of at least one wire.

14. The shelving system of claim 13, wherein each bracket further comprises a center portion of the body between the slots and a resilient pad mounted to the center portion, the resilient pad configured to apply pressure to a wire of the wire shelf deck.

15. A shelving system for mounting to a fixed shelf that is in a substantially fixed position, the shelving system comprising:

at least two brackets that are configured to engage the fixed shelf;

at least one rigid strap depending from each bracket;

two frames comprising wire, the frames for forming ends of the shelving system, each frame including a shelf supporting element including a first shelf rod receiving element, a second shelf rod receiving element and a shelf retaining portion, each frame associated with and releasably attached to one of the rigid straps; and a shelf including a first rod and a second rod spaced from the first rod, the shelf supported by the shelf supporting element and retained in place with the shelf retaining portion, wherein the first shelf rod receiving elements are configured to receive and support the first rod, and the second shelf rod receiving elements are configured to receive and support the second rod, and wherein the shelf rod receiving elements each include spring-like biasing means for retaining the shelf in an assembled position.

16. The shelving system of claim 15, wherein the shelf supporting element is formed from wire.

17. A method of assembling a shelving system for mounting to a fixed shelf that is in a substantially fixed position, the method comprising:

mounting at least two brackets to the shelf by receiving the shelf between a pair of legs of each bracket;

hanging at least one rigid strap from each bracket, the rigid strap engaging the associated bracket with a hook at a slot defined by one leg of each bracket;

hanging a frame from each rigid strap, the frame comprising wire, each rigid strap engaging the corresponding frame by receiving the wire of the fram each frame including a shelf supporting element including a shelf rod receiving element, biasing means, and a shelf retaining portion, wherein the biasing means comprises bent wire at each end of the shelf retaining portion, and wherein the biasing means is spring-like and urges the shelf retaining means to apply force to the shelf;

providing a shelf including shelf rods;

deflecting the shelf retaining portion and advancing the shelf past the shelf retaining portion;

seating the shelf on each shelf supporting element such that the rods are received in the shelf rod receiving elements; and allowing the shelf rod retaining element to be positioned above the shelf to retain the shelf in position with the rods seated in the shelf rod receiving elements.

18. The method of claim 17, further comprising allowing the biasing means to apply force to the shelf such that the rods remain seated in the shelf rod receiving elements.

* * * * *

UNITED STATES PATENT AND TRADEMARK OFFICE

CERTIFICATE OF CORRECTION

PATENT NO. : 8,910,805 B2
APPLICATION NO. : 13/590716
DATED : December 16, 2014
INVENTOR(S) : Michael Gregory et al.

It is certified that error appears in the above-identified patent and that said Letters Patent is hereby corrected as shown below:

In the Claims:

In column 18, claim 17, please change line 31 to:

"frame by receiving the wire of the frame in a hook, each frame"

Signed and Sealed this
Seventh Day of April, 2015

Michelle K. Lee

Michelle K. Lee
*Director of the United States Patent and Trademark Office*